US005784081A

United States Patent [19]

Ozaki et al.

[11] Patent Number: 5,784,081

[45] Date of Patent: Jul. 21, 1998

[54] METHOD OF AND APPARATUS FOR CLEANING INK JET HEAD

[75] Inventors: Mitsuo Ozaki; Shigeharu Suzuki; Shino Sakai; Keita Akeno; Shigeyoshi Umemiya; Yasuo Yamagishi, all of Kawasaki, Japan

[73] Assignee: Fujitsu Limited, Kanagawa, Japan

[21] Appl. No.: 409,094

[22] Filed: Mar. 23, 1995

[30] Foreign Application Priority Data

Apr. 21, 1994 [JP] Japan ..... 6-106104

[51] Int. Cl.[6] ..... B41J 2/165

[52] U.S. Cl. ..... 347/30; 347/32

[58] Field of Search ..... 347/30, 28, 32

[56] References Cited

U.S. PATENT DOCUMENTS

| | | | |
|---|---|---|---|
| 4,739,340 | 4/1988 | Terasawa | 347/30 |
| 4,825,231 | 4/1989 | Nozaki | 347/30 |
| 4,952,947 | 8/1990 | Kyoshima | 347/30 |
| 5,027,134 | 6/1991 | Harmon et al. . | |
| 5,128,690 | 7/1992 | Nozawa | 347/30 |
| 5,164,748 | 11/1992 | Katayanagi et al. | 347/30 |
| 5,248,999 | 9/1993 | Mochizuki et al. | 347/30 |
| 5,389,961 | 2/1995 | Takagi | 347/30 |
| 5,570,116 | 10/1996 | Soga | 347/30 |

FOREIGN PATENT DOCUMENTS

| | | |
|---|---|---|
| 0 423 475 A1 | 4/1991 | European Pat. Off. . |
| 0 465 260 A2 | 1/1992 | European Pat. Off. . |
| 0 465 260 A3 | 1/1992 | European Pat. Off. . |
| 55-107481 | 8/1980 | Japan . |
| 59-162057 | 9/1984 | Japan . |
| 2-283455 | 11/1990 | Japan . |
| 4-259564 | 9/1992 | Japan . |

OTHER PUBLICATIONS

Prior Art Information List; Dated Jul. 25, 1995; Search Report w/3 cited documents; (1) Publication No.: JP4219250; Publication Date: Aug. 10, 1992, (2) Publication No.: JP4014461; Publication Date: May 8, 1990, (3) Publication No.: JP4235053; Publication Date: Jan. 9, 1991.

Communication–European Search Report; Aplication No.: 95302670.5; Jul. 11, 1995.

*Primary Examiner*—David M. Gray
*Assistant Examiner*—Michael Dalakis
*Attorney, Agent, or Firm*—Armstrong, Westerman, Hattori, McLeland & Naughton

[57] ABSTRACT

Disclosed are a method of and an apparatus for cleaning a plurality of nozzles of an ink jet head. This cleaning method comprises a step of covering a nozzle surface formed with the plurality of nozzles with a cap; a step of depressurizing an air space formed between the nozzle surface and the cap by use of a depressurizing element to suck the inks from the nozzles; a step of stopping the depressurization by the depressurizing element; a step of keeping the nozzle surface covered with the cap so that the inks jetted from the nozzles due to the depressurization wet-spread over the entire nozzle surface by a capillary force; and a step of retracting the cap from the nozzle surface. Further, in this cleaning apparatus, a contact angle θ1 between the ink and the cap internal surface and a contact angle θ2 between the ink and the nozzle surface are set to 90° or smaller and also set such that θ2 is not greater than θ1.

23 Claims, 20 Drawing Sheets

METHOD OF AND APPARATUS FOR CLEANING INK JET HEAD

BACKGROUND OF THE INVENTION

1. Field of the Invention

The present invention relates to an ink jet head cleaning method of and an ink jet head cleaning apparatus for cleaning nozzles of an ink jet head.

2. Description of the Related Art

In an image-forming apparatus, such as a copying machine, a printer and a facsimile apparatus, an ink jet printing mechanism has been on the active utilization. This ink jet printing mechanism forms an image on a recording medium by jetting out inks from nozzles of an ink jet head by a pressure or heating. This type of ink jet head requires a method of effectively removing clogging in the nozzles.

In the ink jet head, ink solvents at the nozzle portions are evaporated. As a result, a ratio of a solute, such as a color material, increases. Besides, an ink viscosity increases, and the solute is deposited and solidified. This leads to clogging in the nozzles enough to hinder the inks from jetting out of the nozzles. So-called nozzle clogging is caused.

Removing this clogging involves the use of an ink sucking/discharging mechanism for sucking and discharging the inks from the nozzles. A conventional ink sucking/discharging mechanism forcibly sucks and discharges the inks from the nozzles. Nozzle clogging matters are eliminated with a flow of the ink.

More specifically, the nozzle surface of the head is covered with a cap, and an interior of the cap is depressurized by a depressurizing pump. Because of this depressurization, the inks are discharged from the nozzles. At this time, there are differences in terms of a clogged state between a plurality of nozzles in the great majority of cases. For example, there exist relatively lightly-clogged nozzles in which the solutes are partially deposited and heavily-clogged nozzles in which the solutes are completely solidified.

When there are differences in the clogged state between the nozzles, the ink are discharged initially from the comparatively lightly-clogged nozzles. At this time, the inks are not discharged from the comparatively heavily-clogged nozzles. Then, the inks are eventually discharged from the comparatively heavily-clogged nozzles, thus restoring the clogged nozzles.

However, when the inks are discharged initially from the lightly-clogged nozzles, no ink is discharged from the heavily-clogged nozzles. In this state, with the discharge of the inks from the lightly-clogged nozzles, an intra-cap pressure rises, and, hence, sucking efficiency is reduced.

For this reason, the heavily-clogged nozzles are not further restored. It is required that the depressurization be increased and a long duration of suction be continued in order to restore all the nozzles inclusive of the clogged nozzles in which the inks are completely solidified.

Hence, there arises a problem of requiring a strong sucking element. Further, another problem is that a restoring time becomes long. Moreover, a total quantity of sucked and discharged inks increases, resulting in such a problem that a quantity of dissipation of the ink also increases.

SUMMARY OF THE INVENTION

It is a primary object of the present invention to provide an ink jet head cleaning method of and an ink jet head cleaning apparatus for easily removing clogging in all the nozzles.

It is another object of the present invention to provide an ink jet head cleaning method of and an ink jet head cleaning apparatus for removing the clogging in all the nozzles with less amount of sucked inks.

It is still another object of the present invention to provide an ink jet head cleaning method of and an ink jet head cleaning apparatus for removing the clogging in all the nozzles in a short restoring time.

To accomplish the objects, according to one aspect of the present invention, there is provided a method of cleaning an ink jet head having a plurality of nozzles for effecting a record by jetting out inks on a recording medium, this method comprising: a step of covering a nozzle surface formed with the plurality of nozzles of the ink jet head with a cap; a step of depressurizing an air space formed between the nozzle surface and the cap by use of a depressurizing means to suck the inks from the nozzles; a step of stopping the depressurization by the depressurizing means; a step of keeping the nozzle surface covered with the cap so that the inks jetted from the nozzles due to the depressurization wet-spread over the entire nozzle surface by a capillary force; and a step of retracting the cap from the nozzle surface.

According to another aspect of the present invention, there is provided an apparatus for cleaning an ink jet head having a plurality of nozzles for effecting a record by jetting out inks on a recording medium, this apparatus comprising: a cap for covering a nozzle surface provided with the plurality of nozzles of the ink jet head; a depressurizing means for depressurizing an air space formed between the nozzle surface and the cap to suck the inks from the nozzles; a cap operating mechanism for closely fitting the cap to the nozzle surface and retracting the cap therefrom; and a control circuit for controlling the cap operating mechanism and the depressurizing means to retract the cap from the nozzle surface subsequent to keeping the nozzle surface covered with the cap so that the inks jetted out of the nozzles due to the depressurization wet-spread over the entire nozzle surface by dint of a capillary force by stopping a drive of the depressurizing means after closely fitting the cap to the nozzle surface and driving the depressurizing means.

According to this aspect of the present invention, the attention is paid to the fact that deposited and solidified solutes causing the heavy clogging exhibit a property of being easily dissolved originally by an ink solvent. More specifically, the deposited and solidified solutes in the heavily-clogged nozzles are positively dissolved by the inks discharged out of the comparatively lightly-clogged nozzles. This facilitates the discharge of the inks out of the heavily-clogged nozzles, thus restoring the clogged nozzles.

Therefore, the inks discharged from the comparatively lightly-clogged nozzles wet spread over the entire nozzle surface. Accordingly, the inks discharged from the lightly-clogged nozzles can reach the heavily-clogged nozzles. The deposited/solidified solutes in the heavily-clogged nozzles are thereby dissolved by the inks. Consequently, this facilitates both the discharge of the inks from the heavily-clogged nozzles and the restoration of the clogged nozzles.

Further, the inks discharged from the lightly-clogged nozzles wet-spread over the nozzle surface, and therefore the clogged nozzles are restorable with a relatively small amount of inks. This makes it possible to prevent the inks from being dissipated with a futility. Further, a restoring time can be also decreased. Moreover, application time of a reduced pressure can be also decreased.

According to still another aspect of the present invention, there is provided an apparatus for cleaning an ink jet head having a plurality of nozzles for effecting a record by jetting out inks on a recording medium, this apparatus comprising: a cap for covering a nozzle surface provided with the plurality of nozzles of the ink jet head; and a depressurizing means for depressurizing an air space formed between the nozzle surface and the cap to suck the inks from the nozzles. A contact angle θ1 between the ink and the cap internal surface and a contact angle θ2 between the ink and the nozzle surface are set to 90° or smaller and also set such that θ2 is not greater than θ1.

According to this aspect of the present invention, the inks discharged from the lightly-clogged nozzles wet-spread the nozzle surface. For this purpose, a better condition is obtained with the smaller contact angles. That is, a wettability increases with the smaller contact angles between the ink and the nozzle surface and between the ink and the cap internal surface. Therefore, the entire nozzle surface can be wet-spread with a less amount of inks. Further, if the contact angle θ2 between the nozzle surface and the ink is equal to or smaller than the contact angle θ1 between the cap internal surface and the ink, the inks spread over the nozzle surface more widely. The entire nozzle surface can be therefore wet-spread with the less amount of inks.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1:
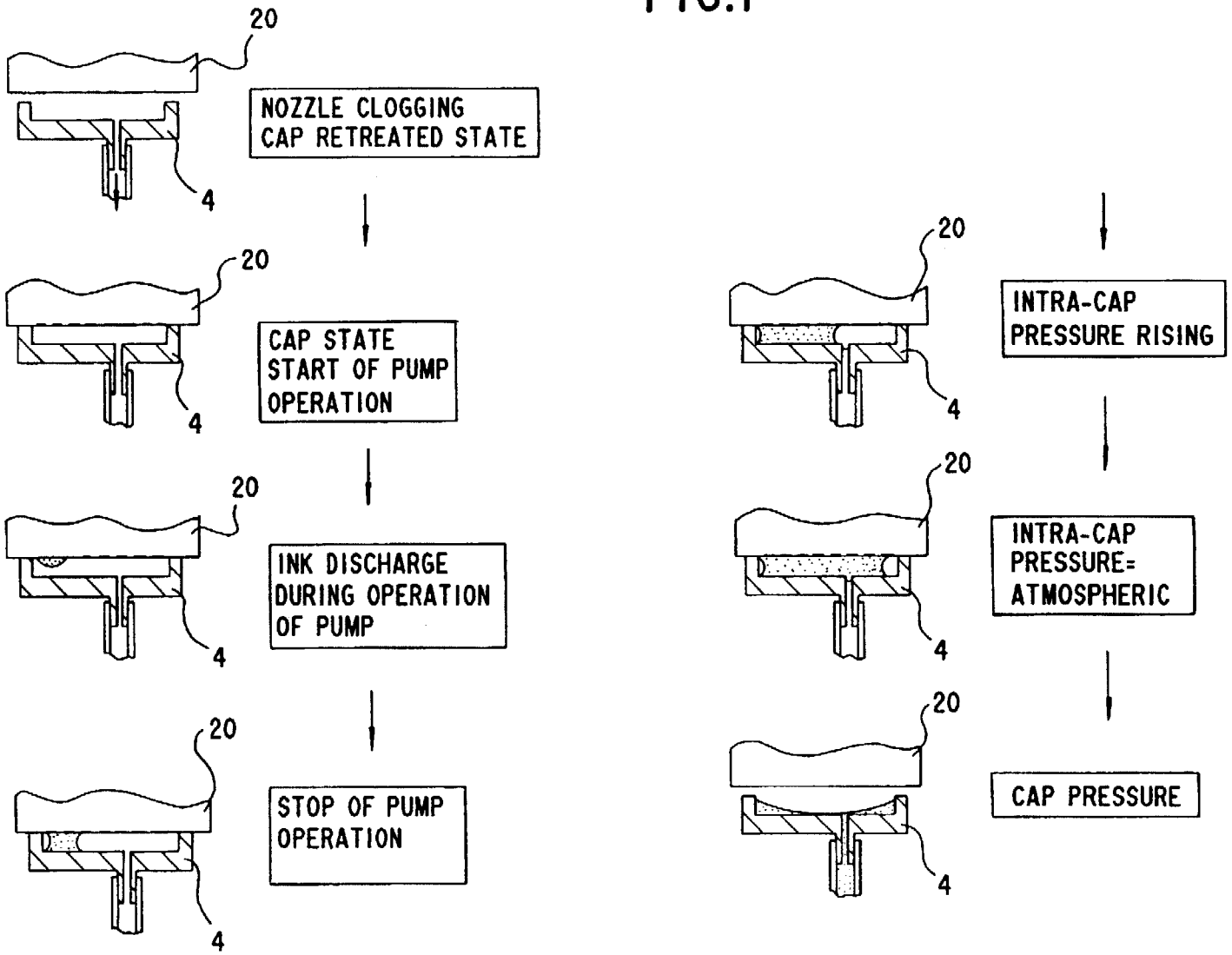
FIG. 1 is a view showing the principle of the present invention.

FIG. 1 is a view showing the principle of the present invention.

As illustrated in FIG. 1, a cap 4 is changed from a retracted state of the cap 4 to a covering state of covering an ink jet head 20. Next, a depressurizing pump is operated to depressurize the interior of the cap 4. An ink is thereby discharged from the head. Hereat, the operation of the depressurizing pump is stopped. At this moment, the interior of the cap 4 is kept in a depressurized state.

Subsequently, the discharged ink wets and spreads over along a nozzle surface of the head 20 within the cap 4. Then, with the discharge of the ink, a pressure in the interior of the cap 4 becomes the atmospheric pressure. At this time, the nozzle surface of the head 20 is filled with the ink. A solid matter is dissolved by the ink in the nozzles having relatively heavy clogging. Finally, the cap 4 is retracted from the head 20.

The ink discharged from this clogging-relieved nozzle wet-spreads over the nozzle surface. For this purpose, the condition becomes better with smaller contact angles. That is, wettability becomes larger with the smaller contact angles made between the ink and the nozzle surface and between the ink and the cap internal surface. The ink can be thereby wet-spread over the entire nozzle surface.

Especially when the contact angle, is 90° or smaller, a less amount of ink can wet-spread over the entire nozzle surface. Further, if a contact angle θ2 between the nozzle surface and the ink is equal to or smaller than a contact angle θ1 between the cap internal surface and the ink, a larger amount of ink spreads over the nozzle surface. For this reason, a less amount of ink can wet-spread over the entire nozzle surface.

Figure 2:
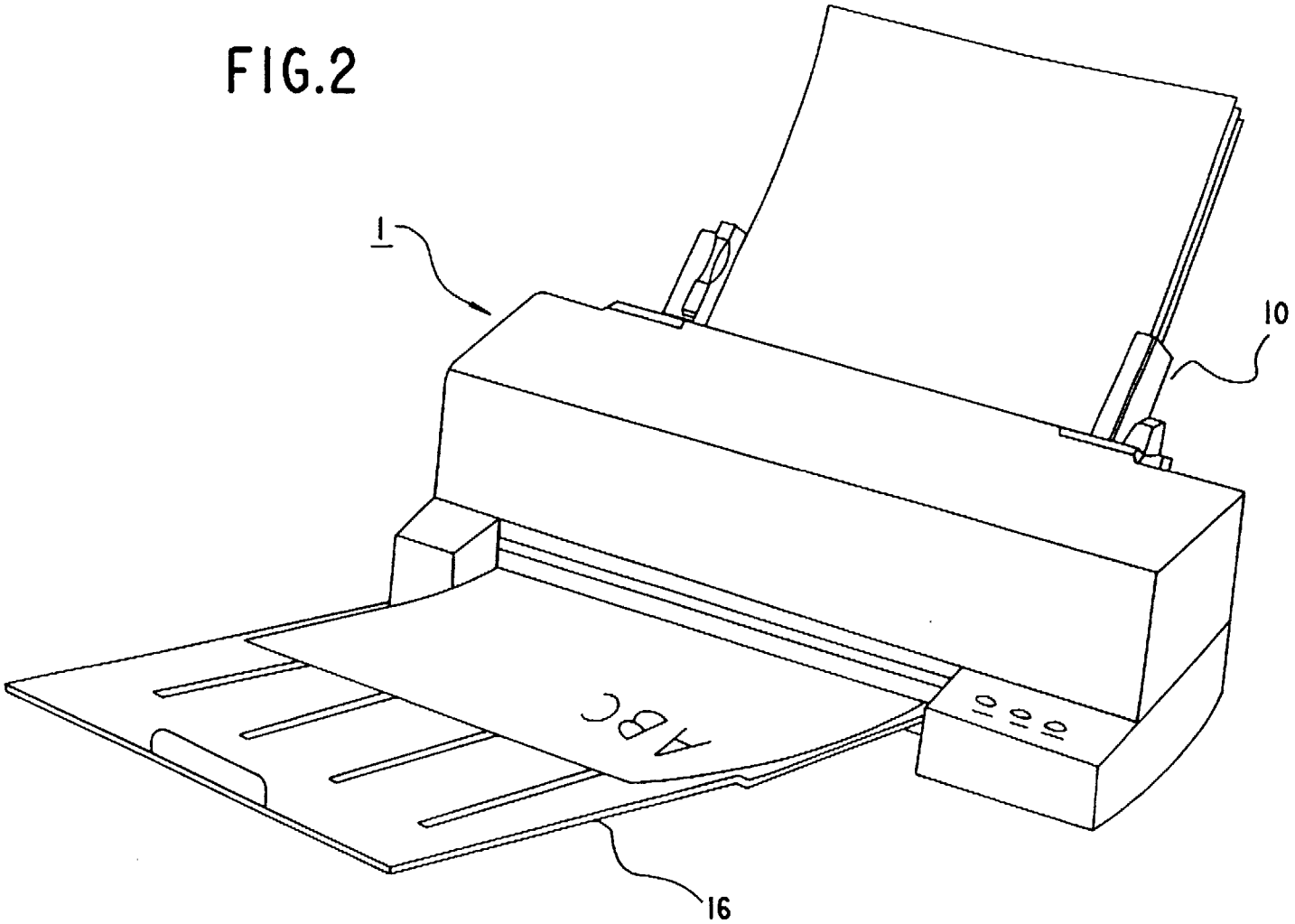
FIG. 2 is a perspective view illustrating a printer in one embodiment of the present invention.
Figure 3:
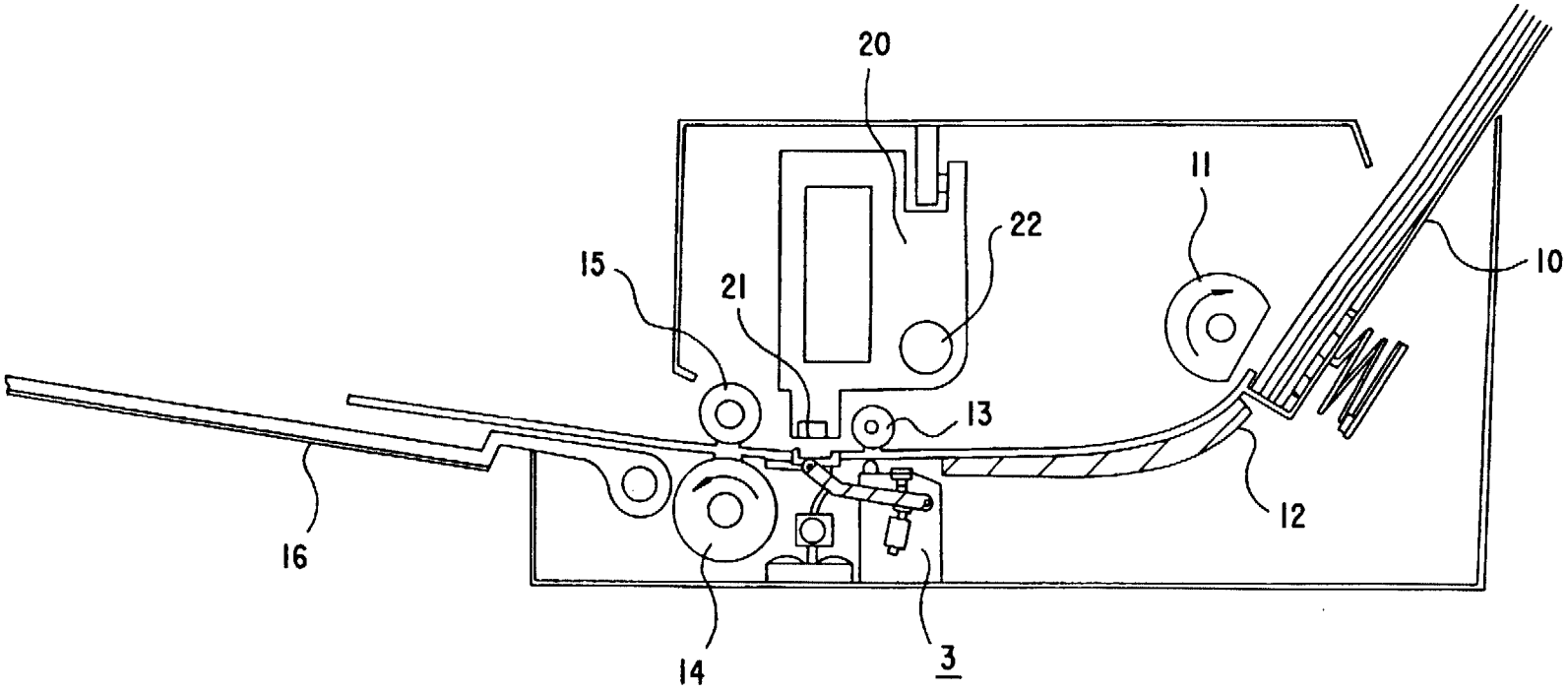
FIG. 3 is a sectional view of the printer shown in FIG. 2.
Figure 4:
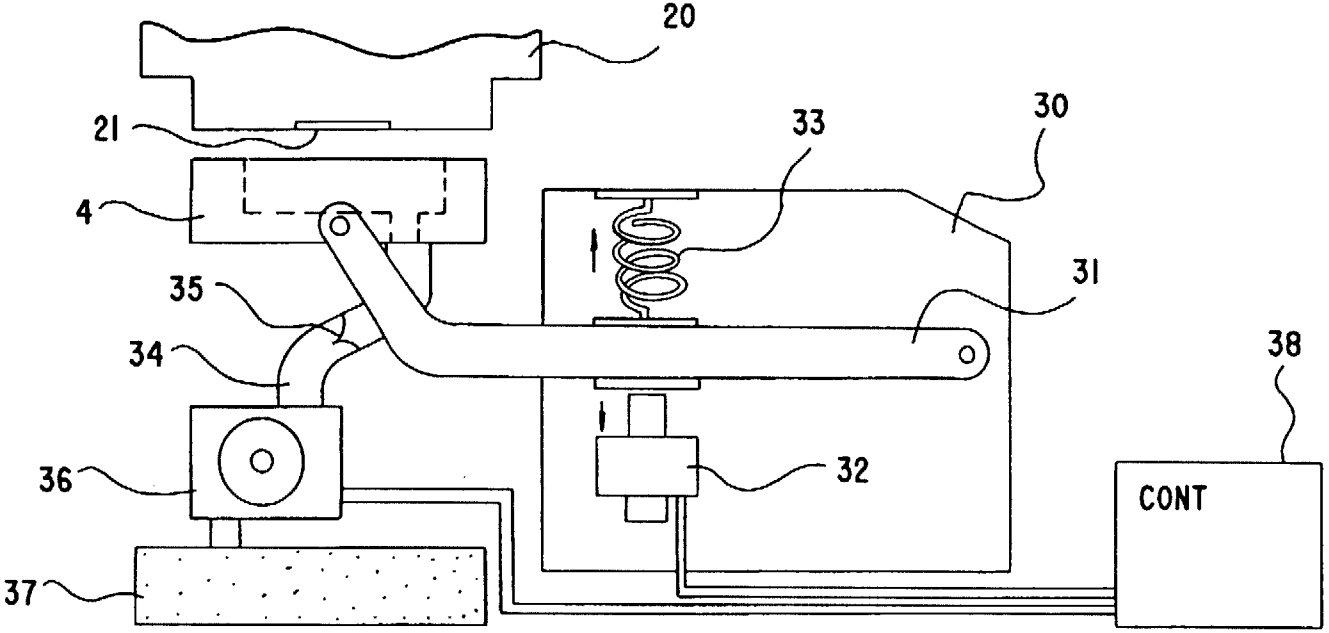
FIG. 4 is a sectional view illustrating a cleaning mechanism shown in FIG. 3.
Figure 5A:
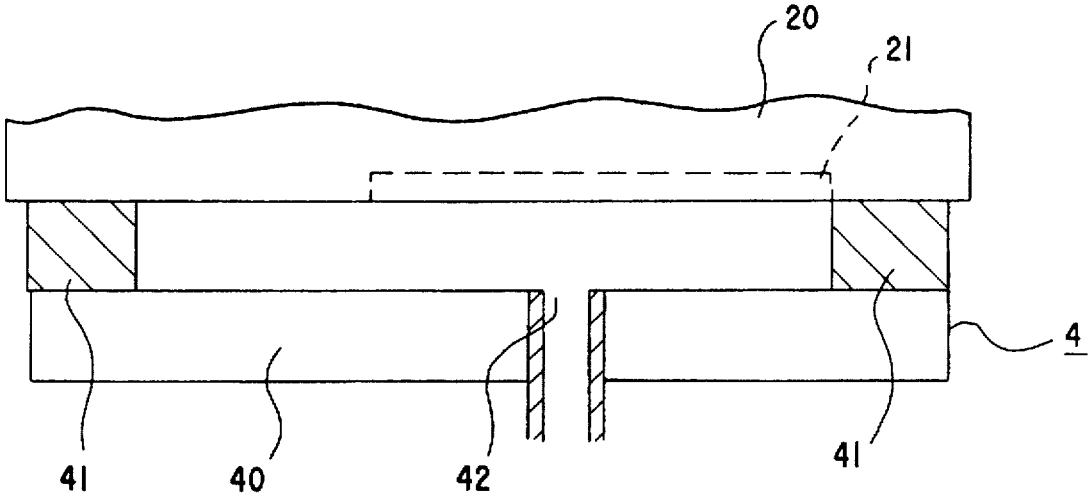
FIGS. 5A and 5B are views illustrating a configuration of a cap shown in FIG. 4.
Figure 5B:
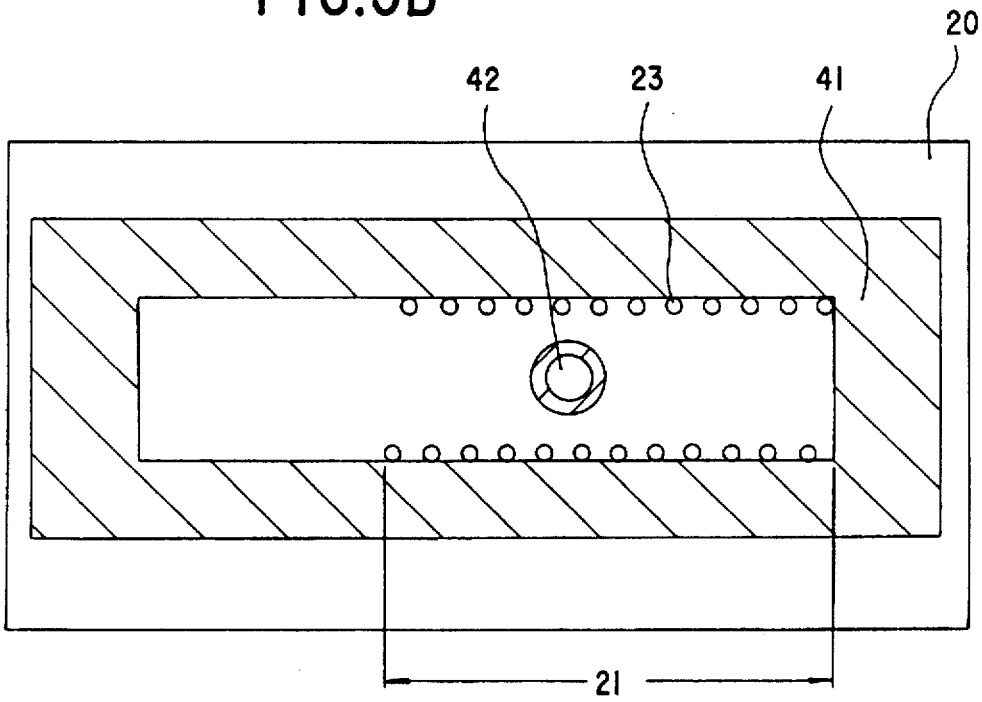

FIG. 2 is a perspective view illustrating a printer in one embodiment of the present invention. FIG. 3 is a sectional view of the printer of FIG. 2. FIG. 4 is a sectional view illustrating a cleaning mechanism of FIG. 3. FIGS. 5A and 5B are views showing a configuration of the cap of FIG. 4.

As illustrated in FIG. 2, a printer body 1 is equipped with a sheet insertion guide 10 and a sheet discharge guide 16. The sheet insertion guide 10 is a guide for inserting an unprinted sheet into the printer 1. The sheet discharge guide 16 serves to accommodate the discharged sheet. Accordingly, the sheet set in the sheet insertion guide 10 passes through the printer body 1 and is discharged to the sheet discharge guide 16.

As depicted in FIG. 3, pick-up rollers 11 pick up the sheet on the sheet insertion guide 10. A sheet guide 12 guides the sheet picked up. Sheet hold rollers 13 hold the sheet in front of the head 20. Feed rollers 14 feed the sheet in rear of the head 20. Sheet hold rollers 15 act so that the sheet is sandwiched in between the feed rollers 14 and the sheet hold rollers 15.

The ink jet head 20 is provided in such a manner that a nozzle surface 21 is set downward. The ink jet head 20 moves along a shaft 22 extending in a depthwise direction in the figure. The cleaning mechanism 3 cleans the nozzle surface 21 of the ink jet head 20. This cleaning mechanism 3 is provided outwardly of a printing area of the ink jet head 20 but downwardly of the nozzle surface 20.

As illustrated in FIG. 4, the cleaning mechanism 3 has the cap 4 for covering the nozzle surface 21 of the head 20. A cap operating mechanism 30 includes an arm 31 connected to the cap 4, an electromagnet 32 for moving the arm 31 up and down and a spring coil 33.

A tube 34 serves to connect the cap 4 to the depressurizing pump 36. The tube 34 is provided with a one-way valve 35. The depressurizing pump 36 depressurizes the interior of the cap 4 through the tube 34. A disposal ink reservoir 37 reserves the ink sucked by the depressurizing pump 36. A microprocessor-based control circuit 38 drive-controls the electromagnet 32 and the depressurizing pump 36.

When cleaning the ink jet head 20, the head 20 is located in a position of the cleaning mechanism 3. Next, the electromagnet 32 is driven to operate the arm 31. The cap 4 is thereby closely fitted to the ink jet head 20 so that the cap 4 covers the nozzle surface 21 of the ink jet head 20.

Subsequently, the depressurizing pump 36 is operated to depressurize the interior of the cap 4. Then, after stopping the depressurization by the depressurizing pump 36, and after a predetermined time has elapsed, the drive of the electromagnet 32 is stopped, thereby returning the arm 31. The cap 4 is thereby retracted from the ink jet head 20.

As illustrated in FIG. 5A, the cap 4 includes a base plate 40 composed of glass and a side wall 41 provided to form an internal space above the base plate 40. An opening 42 to which the tube 34 is connected is formed substantially in the central portion of the base plate 40. As depicted in FIG. 5B, this opening 42 is formed in a position bearing a face-to-face relationship with the nozzle surface 21.

The nozzle surface 21 is provided with two rows of nozzles 23 in which twelve dots are prepared per row. The opening 42 is positioned between the two nozzle trains.

Herein, in FIG. 5B, with respect to the nozzle surface 21, there is illustrated only the region in which the nozzles 23 are arranged. On the other hand, the side wall 41 is composed of an elastic material such as butyl rubber, etc. With this composition, the cap 4 can be closely fitted to the wall surface of the ink jet head 20. Herein, the nozzle surface 21 of the ink jet head 20 is formed of the glass.

Figure 6A:
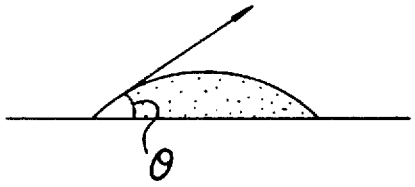
FIGS. 6A and 6B are diagrams of assistance in explaining a contact angle of a liquid.
Figure 6B:
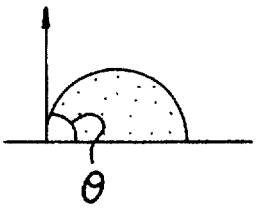

FIGS. 6A and 6B are explanatory views each showing a contact angle. The contact angle θ is conceived as an angle made by a liquid surface and a solid body surface in a place where a free surface of a static liquid faces to a solid body wall. Herein, as illustrated in FIG. 6A, if the contact angle θ is an acute angle, the liquid assumes a property to wet the solid body. On the other hand, as shown in FIG. 6B, if the contact angle is an obtuse angle, the liquid does not wet the solid body but takes a spherical shape on the solid body.

Herein, in the example of the above material, both of the contact angle θ2 between the ink and the nozzle surface 21 and the contact angle θ1 between the ink and the internal surface of the cap 4 are acute angles, and a sufficient wettability is exhibited. That is, both of the contact angles θ2 and θ1 are approximately 15°.

Figure 7:
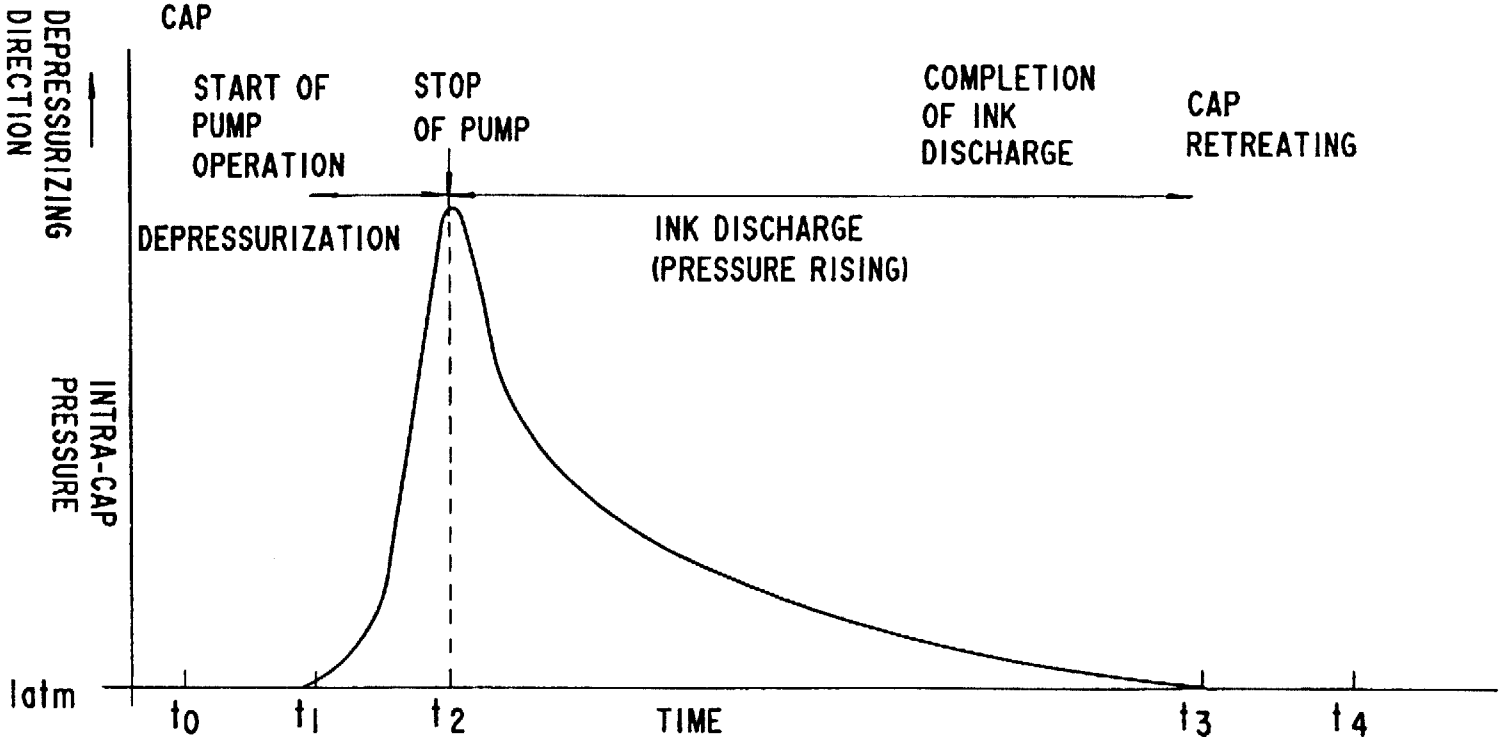
FIG. 7 is a diagram of assistance in explaining an intra-cap pressure according to the present invention.
Figure 8:
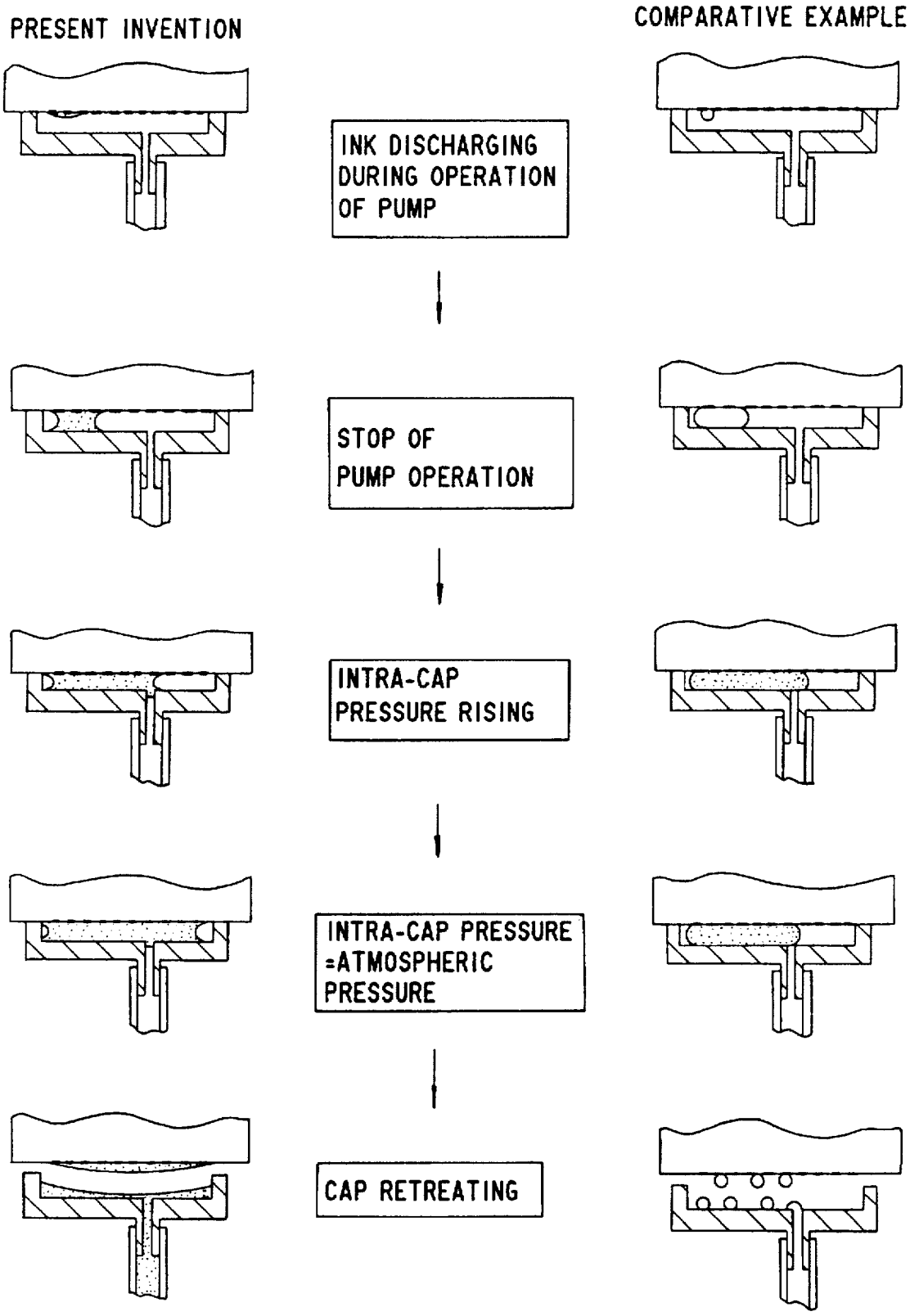
FIG. 8 is an operation explanatory diagram of the present invention versus comparative examples.

FIG. 7 is an explanatory view showing an intra-cap pressure according to the present invention. FIG. 8 is an operating explanatory view of the present invention versus comparative examples. Note that in FIG. 8, a series of examples of the present invention are shown on the left side, while a series of comparative example are illustrated on the right side.

As illustrated in FIG. 7, to start with, at a timing t0, the cap 4 is closely fitted to the head 20. Then, thereafter, at a timing t1, the depressurizing pump 36 is operated, and an air space formed by the head 20 and the internal surface of the cap 4 is depressurized.

When coming to a timing t2 at which a predetermined reduced pressure is reached, the depressurizing pump 36 is stopped. During this period, the inks are discharged from comparatively lightly-clogged nozzles 23. Then, the contact angle θ2 between the ink and the nozzle surface 23 is 90° or under, and, therefore, the ink is adhered to the nozzle surface 21 enough to wet the nozzle surface 21.

As depicted in FIG. 7, these inks are discharged with a passage of time. With this discharging, the intra-cap pressure rises. Meanwhile, the quantity of the suck-discharged inks increases, with the result that a gap between the nozzle surface 21 and the internal surface of the cap 4 is filled with the ink. Since the contact angle θ1 between the ink and the internal surface of the cap 4 is 90° or smaller, and, hence, the nozzle surface is easily wetted. For this reason, the discharged ink, by dint of a capillary force, wet-spreads over the easier-to-wet nozzle surface 21 through the gap. Then, the heavily-clogged nozzles 23 undergoing no ink suction and no ink discharge are also covered within.

Subsequently, at a timing t4 posterior to a timing t3 at which the discharge of a predetermined quantity of ink is to be completed, the cap 4 is retracted. In the meantime, in the heavily-clogged nozzles 23 subjected to no ink suction and no ink discharge, the deposited or solidified solutes are dissolved by the discharged ink, and the clogging is thus removed.

In this way, the inks discharged from the lightly-clogged nozzles wet-spread over the nozzle surface by dint of the capillary force, and consequently the heavily-clogged nozzles can be covered with the discharged inks. Therefore, the deposited or solidified solutes of the heavily-clogged nozzles 23 can be dissolved. This facilitates the restoration of the heavily-clogged nozzles 23.

In contrast with this, according to the comparative examples wherein the contact angle is the obtuse angle, as shown on the right side in FIG. 8, the ink discharged takes a ball-like shape on the nozzle surface 21. For this reason, even when depressurized, the discharged ink is hard to spread over the nozzle surface 21. The discharged ink is rather to be sucked by the depressurizing pump 36 before reaching the heavily-clogged nozzles 23. Therefore, it is difficult to restore the heavily-clogged nozzles by covering the heavily-clogged nozzles with the discharged inks.

Next, the contact angle will be explained. To begin with, as a sample (1), there are prepared the made-of-glass cap 4 with butyl rubber being employed as a material of the cap side wall and the head 20 including the nozzle surface 21 composed of the glass. The nozzle 23 of the head 20 assumes a substantially circular shape having a diameter of 60 μm and is 150 μm in length. The ink used at this time is obtained such that a 3% C.I Direct Black 154 dye is dissolved in a 10% diethylene glycol aqueous solution. In this example, both of the contacts angles θ1 and θ2 are approximately 15°.

Next, as a comparative sample (2) employed herein, SUMIFULNON FP-91 (made by Sumitomo Chemical Co., Ltd.) defined as a fluorine series surface processing agent is coated on the nozzle surface 21 of the head 20 and on the internal surface of the cap 4 in the sample (1). The contact angles θ1 and θ2 in this case are approximately 130°.

Further, as a comparative example (3) used herein, SUMIFULNON FP-91 (made by Sumitomo Chemical Co., Ltd.) is coated on only the nozzle surface 21 of the head 20 in the sample (1). The contact angle θ1 in this case is approximately 15°, while the contact angle θ2 is approximately 130°.

Additionally, as a sample, (4) there are employed the head 20 having its nozzle surface made of stainless steel and the cap 4 made of an acrylic resin. The contact angle θ1 thereof is approximately 70°, while the contact angle θ2 is approximately 35°.

Two sets of the heads 20 in each of the samples (1)–(4) are left as they are at 25° C. for 48 hours under a 20% RH environment, and substantially the same clogged state is actualized. In consequence of this, in each of nearly 8–10 nozzles or thereabouts, it happens that the solute is deposited and solidified. Each of these heads 20 is cleaned by use of the cleaning mechanism 4. This cleaning process is effected under the same conditions, and the ink is sucked under 0.5 atm.

As a result, in the sample (1), the inks discharged from the lightly-clogged nozzles fill the gap between the nozzle surface and the cap internal surface and thus wet-spread over the entire nozzle surface. In the sample (2), the inks discharged from the lightly-clogged nozzles are discharged out of the opening before reaching the heavily-clogged nozzles. In the sample (3), the inks discharged from the lightly-clogged nozzles fill the gap between the nozzle surface and the cap internal surface but do not spread over the entire nozzle surface. In the sample (4), the inks discharged from the lightly-clogged nozzles fill the gap between the nozzle surface and the cap internal surface and thus wet-spread over the entire nozzle surface. The inks do not, however, spread as wide as the sample (1).

Then, after this cleaning, states of the nozzles are observed by a microscope. All the nozzles have been restored in the samples (1) and (4). Contrastingly, it was observed that eight nozzles and six nozzles were not restored in the samples (2) and (3), respectively.

Accordingly, it was found that the well-conditioned nozzles could be seen in the samples (1) and (4). Further, in general, if the contact angle between the member and the liquid exceeds 90°, it is said that the liquid is hard to wet the member. Besides, if the contact angle is 90° or smaller, it is said that the liquid is easy to wet the member, depending on a discharging force of the liquid and so on.

From the above-mentioned, it is required that both of the contact angles θ1 and θ2 are 90° or smaller as a condition for restoring the heavily-clogged nozzles with the discharged inks. Then, it is also required to establish θ2 not greater than θ1 in order to wet-spread the nozzle surface. Especially, the effect becomes larger, according as the contact angles θ2 and θ1 become smaller enough to be more approximate to 0.

Further, herein, the contact angles are changed in many ways depending on the kinds and states of the cap member and the nozzle surface which contact the inks. Even when changing the composition of the ink, the present invention can be realized. For example, the contact angle is reduced by increasing a quantity of the dye added to the ink. Similarly, the contact angle is also decreased by increasing a quantity of a wetting agent (e.g., diethylene glycol) in the solvent. In addition, the contact angle is decreased by varying the kind of the dye.

The dyes for reducing the above contact angle include, e.g., acid dyes such as C.I. acid black 24, C.I. acid black 26, C.I. acid black 107, C.I. acid black 110, C.I. acid black 139, C.I. acid yellow 3, C.I. acid yellow 23, C.I. acid yellow 29, C.I. acid yellow 38, C.I. acid yellow 65, C.I. acid red 27, C.I. acid red 35, C.I. acid red 42, C.I. acid red 92, C.I. acid red 106, C.I. acid red 122, C.I. acid red 131, C.I. acid red 145, C.I. acid red 161, C.I. acid red 276, C.I. acid red 128, C.I. acid red 249 and C.I. acid blue 9.

Further, as direct dyes, there may be exemplified C.I. direct black 19, C.I. direct black 154, C.I. direct yellow 12, C.I. direct yellow 86, C.I. direct yellow 132, C.I. direct yellow 142, C.I. direct yellow 157, C.I. direct blue 86 and C.I. direct blue 199.

Moreover, as reactive dyes, there may be exemplified C.I. reactive red 24, C.I. reactive red 120, C.I. reactive red 141 and C.I. reactive red 180.

Besides, the contact angle can be reduced depending on the kind of the wetting agent. For instance, the contact angle becomes larger by using ethylene glycol and glycerine than by diethylene glycol. Also, the contact angle becomes smaller by using alkyl ether of glycol such as hexylene glycol and polyethylene glycol than by diethylene glycol. Besides, the contact angle can be adjusted even by an additive such as an surface active agent.

Next, the reduced pressure will be explained. The inks discharged by the ink sucking/discharging operation require a quantity enough to completely wet the whole nozzle region defined as the nozzle surface 21 formed with the nozzles shown in FIG. 5B. This discharged ink quantity is determined based on an initial intra-cap pressure. That is, the inks having the quantity enough to completely wet the whole nozzle region are discharged out of the nozzles. If the whole nozzle region is thus wetted, the dissipation of the ink can be minimized.

Then, when the air within the cap is exhausted corresponding to the ink quantity enough to completely wet the whole nozzle region, the inks are discharged from the nozzles. When the intra-cap pressure reaches 1 atm (atmospheric pressure) which gives a stable state, the inks having the quantity enough to completely wet the whole nozzle region are discharged.

Hence, the ink quantity enough to completely wet the whole nozzle region (nozzle surface) 21 is equal to a volume S·L determined by an area S of the whole nozzle region 21 and a distance L from the cap internal surface corresponding thereto. When exhausting the intra-cap air corresponding to the volume S·L, an intra-cap pressure P0 is given such as 1−(S·L/V), where V is the volume of the gap between the head and the cap 4.

Herein, when a length of the whole nozzle region 21 in FIG. 5B is set to 3.3 mm, and when a width thereof is set to 1.3 mm, the area S of the whole nozzle region 21 is given by $1.3\times3.3=4.3\ mm^2$. When an intra-cap length is set to 5.1 mm, and when an average spacing L between the cap internal surface and the nozzle surface is set to 0.7 mm, an intra-cap volume is given by $1.3\times5.1\times0.7=4.6\ mm^3$. Accordingly, the intra-cap pressure P0 is given from the above formula such as $1-(4.3\times0.7/4.6)=0.35$ atm.

When the inks are suck-discharged under the initial intra-cap pressure on the order of 0.35 atm, the inks wet a large proportion of the whole nozzle region in approximately 5 sec, and the discharge of the inks is completed. On the other hand, the inks are suck-discharged under the initial intra-cap pressure of 0.65 atm, the inks wet about a half of the whole ink region in approximately 8 sec, and the discharge of the inks is completed. When observing the states of the nozzles, in the former case, no deposited state and no solidified state could not be seen in all the nozzles. On the other hand, in the latter case, the solidified state can be seen in nine pieces of nozzles in the region wetted with no ink.

Next, when the inks are suck-discharged under the initial intra-cap pressure of 0.25 atm smaller than 0.35 atm, the whole nozzle region is completely wetted in approximately 2 sec. At this moment, the cap is forcibly retreated and opened to the atmospheric pressure, thus completing the discharge of the inks. When observing the nozzle states, neither deposited states nor solidified states can be seen all the nozzles.

As described above, it is required that the intra-cap pressure P0 be 1–(S·L/V) or under. Further, a discharging speed of the ink becomes higher with a lower initial intra-cap pressure P0, and the whole nozzle region can be surely wetted. However, a quantity of dissipation of the ink increases correspondingly, and, besides, the sucking mechanism for the depressurization is required to have a high performance.

Figure 9A:
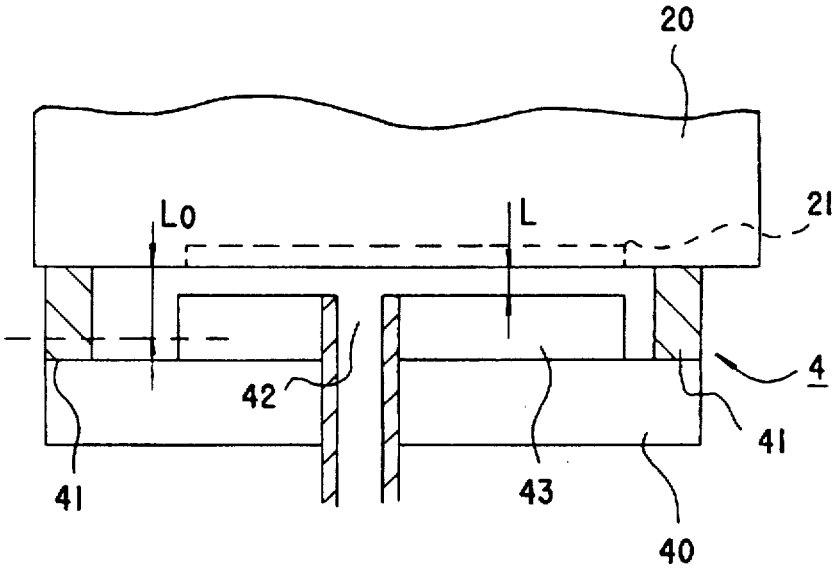
FIGS. 9A and 9B are constructive views showing a modified example of the cap according to this invention.
Figure 9B:
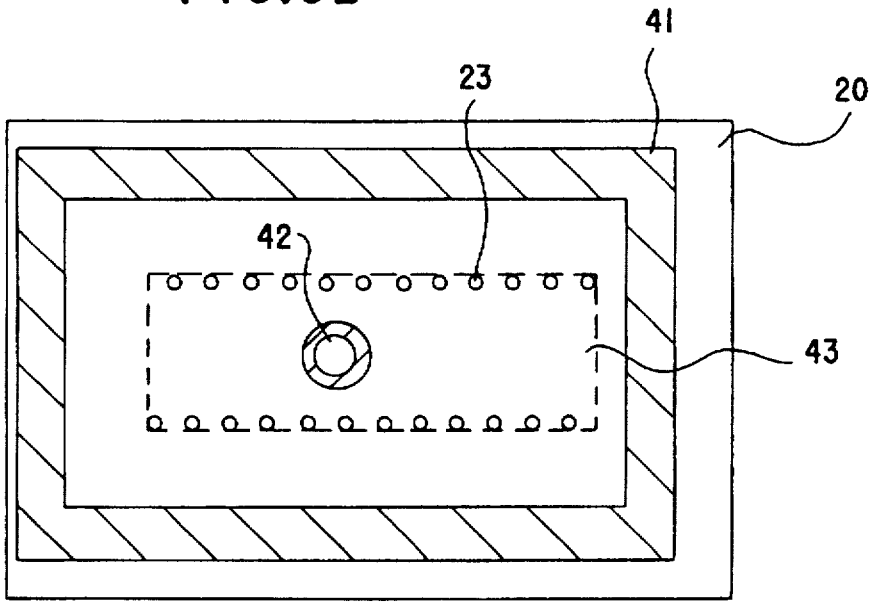

FIGS. 9A and 9B are constructive views showing a modified example of the cap. As illustrated in FIGS. 9A and 9B, an auxiliary plate 43 formed with an opening 42 is disposed in a face-to-face position with the nozzle surface 21 on a base plate 40 of the cap 4. This auxiliary plate 43 is composed of the glass. Then, this auxiliary plate 43 works to narrow the gap within the cap 4, corresponding to the portion of the nozzle surface 21.

The inks discharged by the sucking/discharging operation of the cleaning mechanism 4 fill a narrow gap between the whole nozzle region (nozzle surface) 21 and the auxiliary plate 43. Thereafter, the inks overflow from this gap and fill the cap interior having a wide spacing from under. That is, the whole nozzle region can be wetted with a small amount of the discharge inks at the maximum velocity.

Figure 10A:
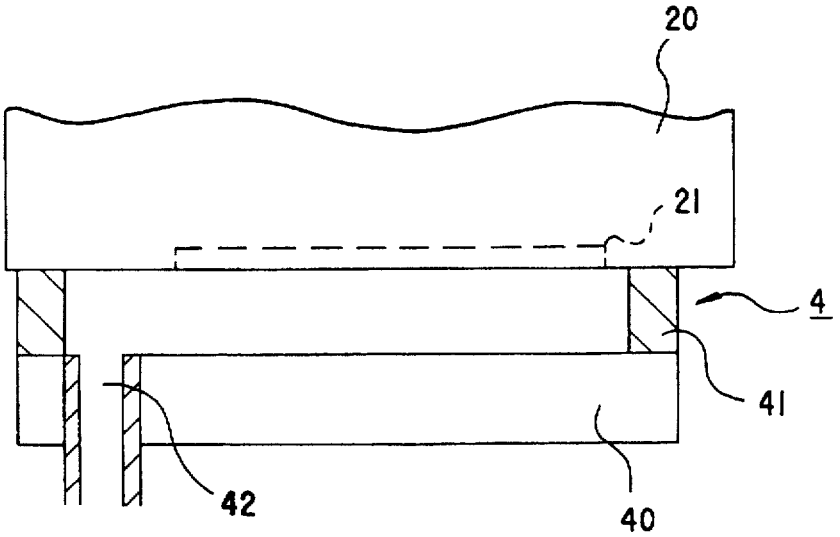
FIGS. 10A and 10B are constructive views showing another modified example of the cap according to this invention.
Figure 10B:
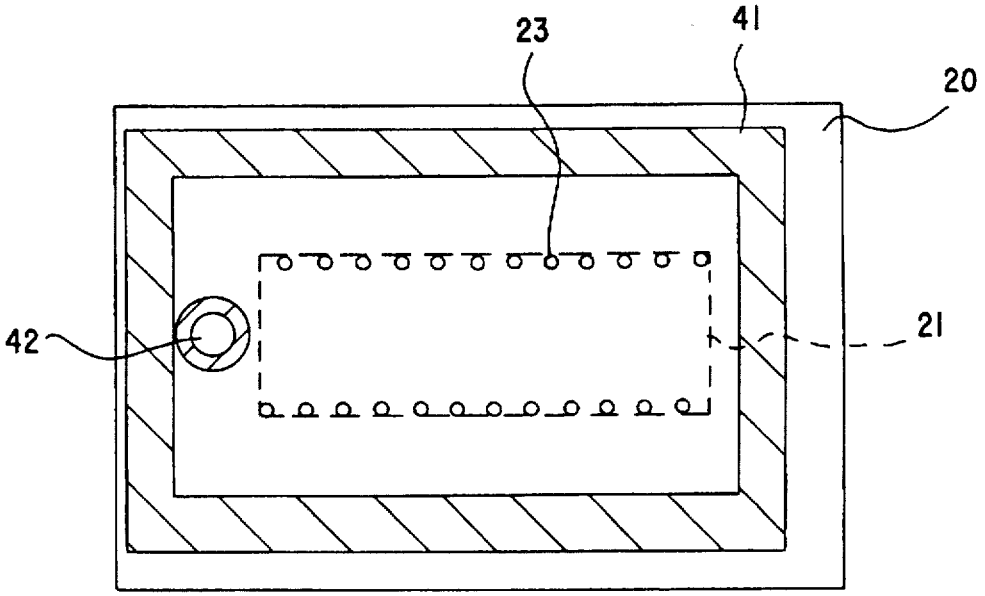

FIGS. 10A and 10B are constructive views showing another modified example of the cap. As illustrated in FIGS. 10A and 10B, the opening 42 for the depressurization is formed in a position exclusive of the face-to-face position with the whole nozzle region 21 of the base plate 40. That is, the opening 42 is formed in the position at the edge of the base plate 40.

This arrangement makes it difficult to suck the inks discharged by the depressurizing pump 36 from the opening 42. It is therefore possible to hold a greater quantity of inks in the cap 4. Accordingly, the whole nozzle region 21 can be completely wetted with a less quantity of inks. Further, the whole nozzle region 21 can be wetted in a short time.

Figure 11A:
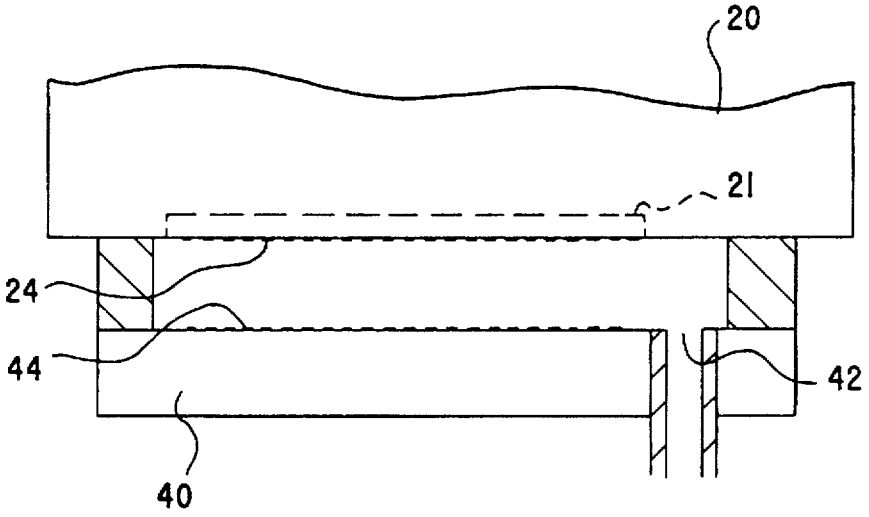
FIGS. 11A and 11B are constructive views showing still another modified example of the cap according to this invention.
Figure 11B:
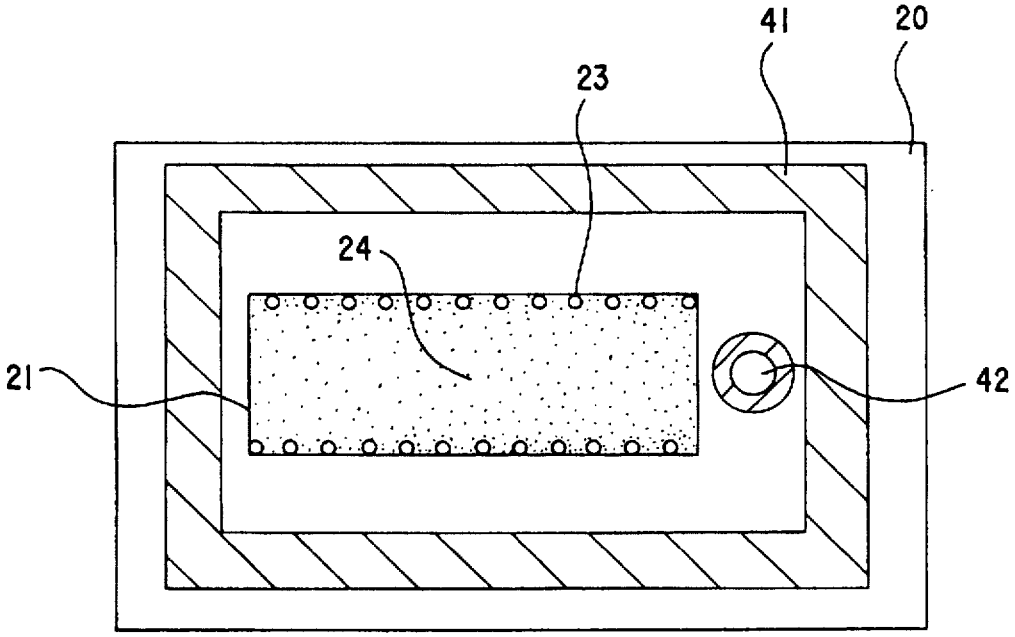

FIGS. 11A and 11B are constructive views showing still another modified example of the cap. As depicted in FIGS. 11A and 11B, hydrophilic processing agents 24, 44 such as a soap are applied on a surface taking the face-to-face relationship with the whole nozzle region 21 of the base plate 40 as well as on the whole nozzle region 21.

With this processing, the discharged inks selectively fill the whole easy-to-wet nozzle region 21 and the internal surface of the cap 4 which faces thereto. This makes it possible to wet the whole nozzle region 21 with the less quantity of inks. Further, the whole nozzle region 21 can be wetted in a short time.

Reversely to this, a hydrophobic processing agent such as wax and oil may be applied on a surface other than the surface taking the face-to-face relationship with the whole nozzle region 21 of the base plate 40 as well as on the whole nozzle region 21.

Figure 12A:
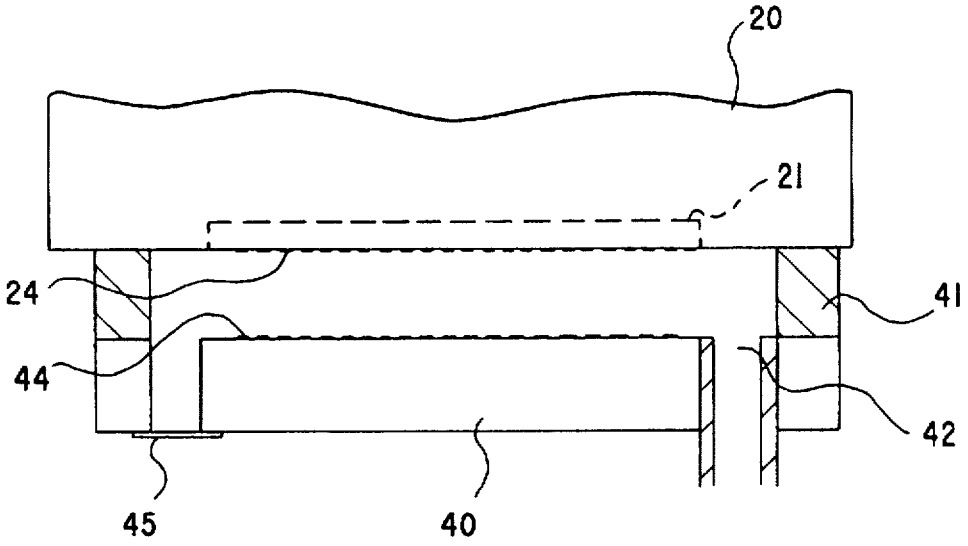
FIGS. 12A and 12B are constructive views showing a further modified example of the cap according to this invention.
Figure 12B:
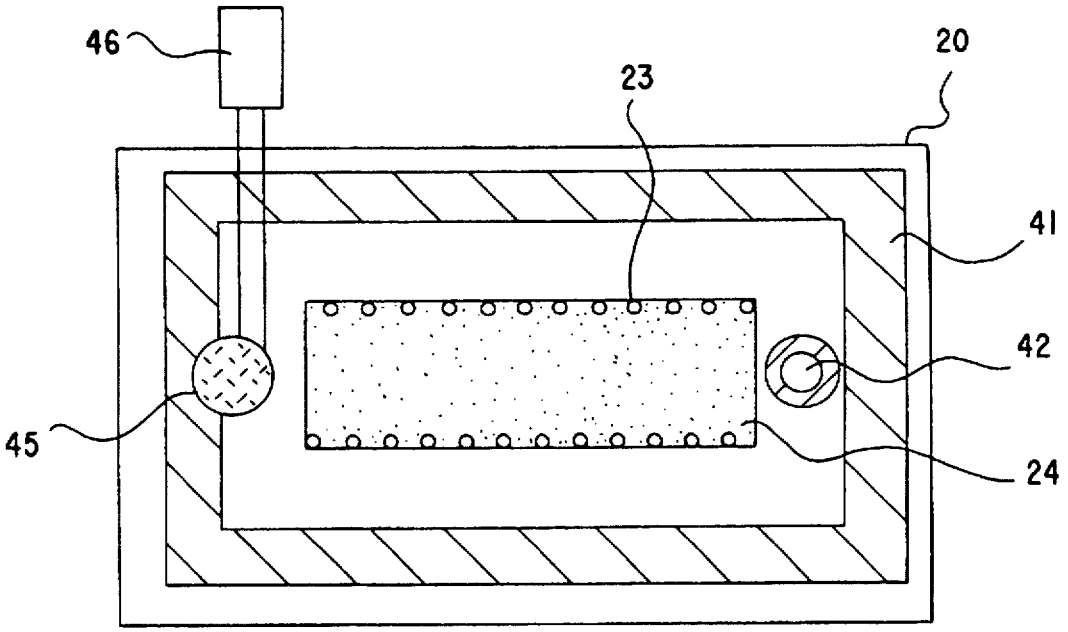

FIGS. 12A and 12B are constructive views showing a further modified example of the cap. As illustrated in FIGS. 12A and 12B, the base plate 40 is fitted with a pressure sensor 45 for measuring an intra-cap pressure. This pressure sensor 45 is constructed of a piezoelectric film. Then, the pressure sensor 45 deforms in accordance with a magnitude of the pressure within the cap 4 and outputs a trace-of-voltage signal corresponding to a quantity of this deformation.

This signal is amplified by an amplifier 46 and inputted to the control circuit 38 (see FIG. 4). The control circuit 38 detects the intra-cap pressure, thus making it possible to control the depressurizing pump 36.

That is, during the operation of the depressurizing pump 36, the intra-cap pressure is reduced, and the pressure sensor 45 indicates a high voltage. Even when the depressurizing pump 36 is stopped, the interior of the cap is not opened to the atmospheric pressure by the one-way valve 35 (see FIG. 4), and the depressurized state is kept. Hence, the suction and the discharge of the ink continue, and the intra-cap pressure rises with the discharge of the ink. The clogging may be removed simply by discharging the ink until the whole nozzle region is wetted. If the inks are discharged over this level, this leads to a futility of the inks. Then, the depressurizing pump 36 is controlled by monitoring a pressure of the pressure sensor 45. The nozzles can be thereby restored with the minimum quantity of inks in the minimum time.

Figure 13:
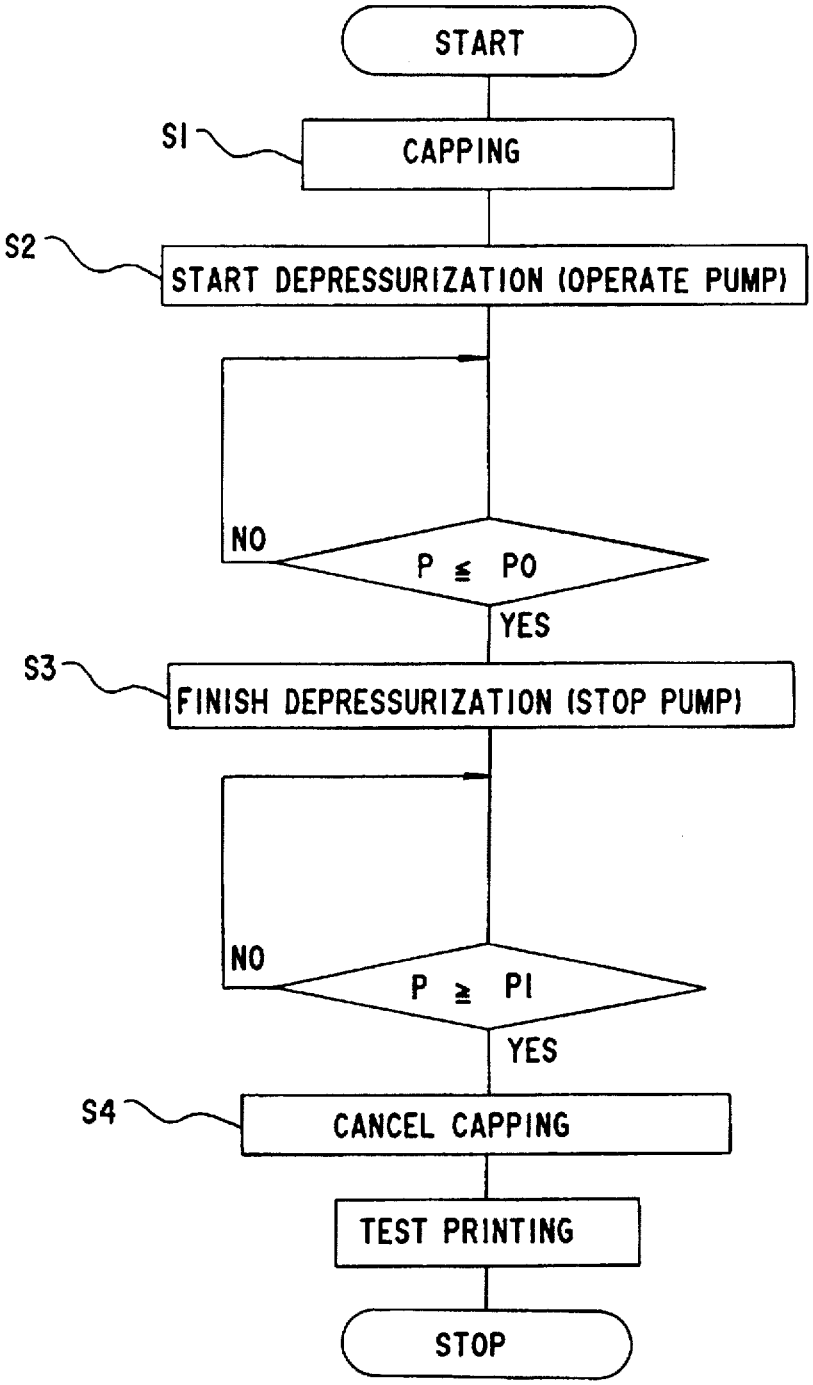
FIG. 13 is an operation flowchart in a first modified example of the present invention.

FIG. 13 is an operation flowchart in a first modified example of the present invention. In this modified example, there is used the cap 4 shown in FIGS. 12A and 12B.

(S1) If the user recognizes the nozzle clogging from a printing state and so forth, there is turned ON a switch for starting the ink cleaning operation on an operation panel. The operation is thereby started. Performed at first is a capping operation of covering the nozzle surface 21 of the head 20 with the cap 4.

(S2) Next, the control circuit 38 operates the depressurizing pump 36 to reduce the intra-cap pressure. The control circuit 38 reads an output of the pressure sensor 45 at an interval of a predetermined time and thus detects an intra-cap pressure. The control circuit 38 determines whether or not an intra-cap pressure P is equal to or smaller than a predetermined depressurization stopping pressure P0=1–S·L/V (where S is the area of the whole nozzle region, L is the average spacing between the whole nozzle region and the cap internal surface bearing the face-to-face relationship therewith, and V is the intra-cap capacity).

(S3) The control circuit 38, when determining that the intra-cap pressure P is P0 or under (then P=Pa), stops the operation of the depressurization pump 36. Because of the one-way valve 35 provided on a route of the depressurization pump 36, there is produced no rise in terms of the pressure from this route. However, the inks are discharged from the nozzles, and, therefore, the intra-cap pressure P increases. The control circuit 38 reads the output of the pressure sensor 45 at the interval of the predetermined time and thus detects the intracap pressure. Then, the control circuit 38 determines whether or not the intra-cap pressure P is equal to or larger than a predetermined end pressure P1=Pa+S·L/V.

(S4) The control circuit 38, when determining that the intra-cap pressure P is equal to or larger than P1, retracts the cap 4 from the nozzle surface, thus canceling the capping process. At this point of time, the inks discharged into the cap have a quantity greater than needed for wetting the whole nozzle region. Effected subsequently is test printing to jet out the ink, and the cleaning is stopped. The user confirms the restoration of the clogging by seeing a result of this test printing.

In this way, the cleaning is performed while monitoring the intra-cap pressure, thereby indirectly detecting the wettability of the discharged ink to the nozzle surface. Therefore, the cleaning can be effected with a less quantity of the discharged inks.

Figure 14:
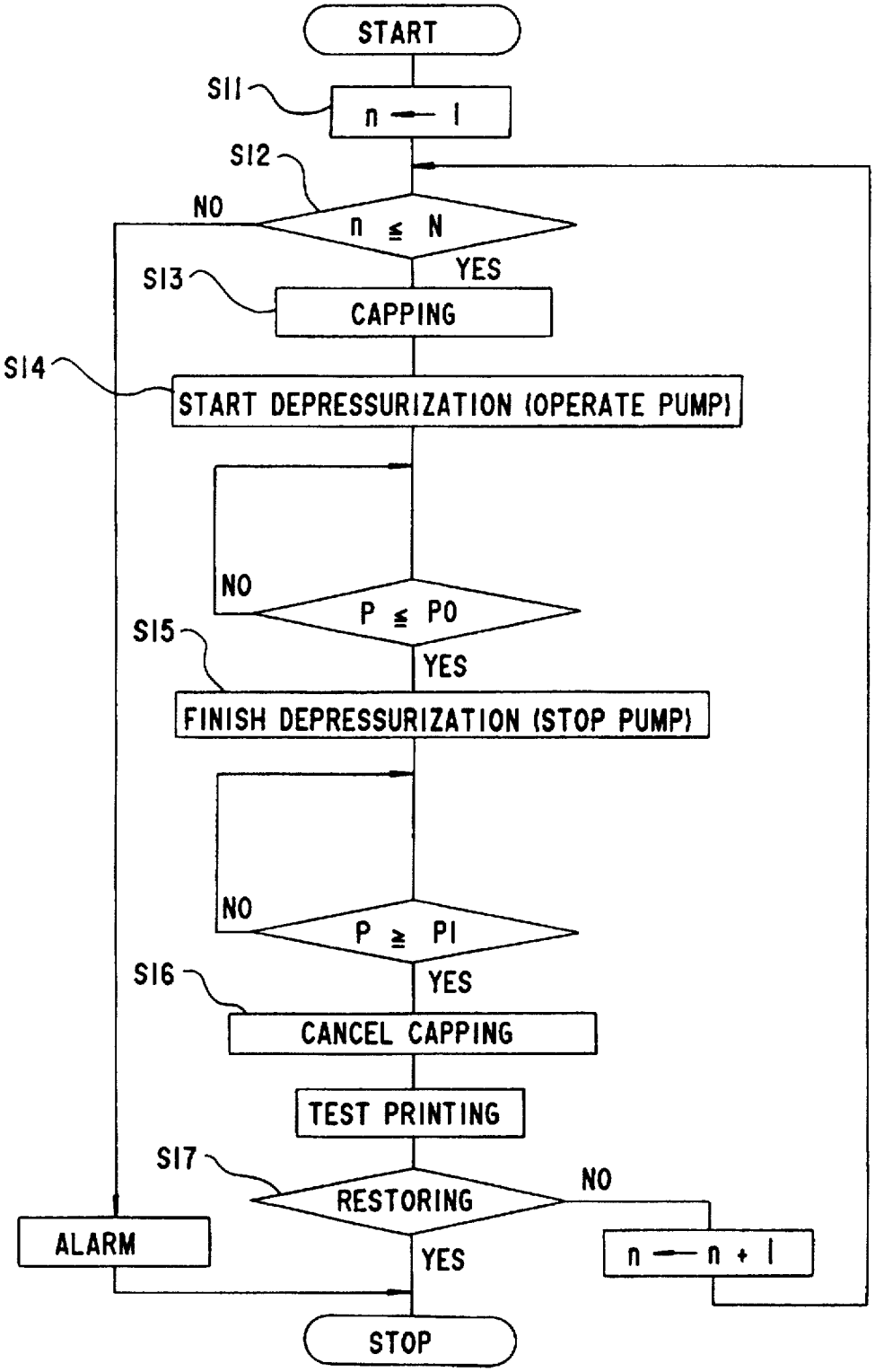
FIG. 14 is an operation flowchart in a second modified example of the present invention.

FIG. 14 is an operation flowchart in a second modified example of the present invention. In this modified example also, there is used the cap 4 shown in FIGS. 12A and 12B.

(S11) If the user recognizes the nozzle clogging from a printing state and so forth, there is turned ON the switch for starting the ink cleaning operation on the operation panel. The operation is thereby started. A number-of-times parameter n is initialized to [1].

(S12) The control circuit 38 determines whether or not the number-of-times parameter n is equal to or smaller than a limit number-of-times N. If the number-of-times parameter n is not equal to or smaller than the limit number-of-times N, this implies an excess in terms of the number of times, and therefore the operation is stopped by giving an alarm.

(S13) If the number-of-times parameter n is equal to or smaller than the limit number-of-times N, there is performed at first the capping operation to cover the nozzle surface 21 of the head 20 with the cap 4.

(S14) Next, the control circuit 38 operates the depressurizing pump 36 to reduce the intra-cap pressure. The control circuit 38 reads the output of the pressure sensor 45 at the interval of the predetermined time and thus detects the intra-cap pressure. The control circuit 38 determines whether or not the intra-cap pressure P is equal to or smaller than the predetermined depressurization stopping pressure $P0=1-S\cdot L/V$ (where S is the area of the whole nozzle region, L is the average spacing between the whole nozzle region and the cap internal surface bearing the face-to-face relationship therewith, and V is the intra-cap capacity).

(S15) The control circuit 38, when determining that the intra-cap pressure P is P0 or under (then P=Pa), stops the operation of the depressurization pump 36. Because of the one-way valve 35 provided on the route of the depressurization pump 36, there is produced no rise in terms of the pressure from this route. However, the inks are discharged from the nozzles, and, therefore, the intra-cap pressure P increases. The control circuit 38 reads the output of the pressure sensor 45 at the interval of the predetermined time and thus detects the intracap pressure. Then, the control circuit 38 determines whether or not the intra-cap pressure P is equal to or larger than the predetermined end pressure $P1=Pa+S\cdot L/V$.

(S16) The control circuit 38, when determining that the intra-cap pressure P is equal to or larger than P1, retracts the cap 4 from the nozzle surface, thus canceling the capping process. At this point of time, the inks discharged into the cap have the quantity greater than needed for wetting the whole nozzle region. Effected subsequently is test printing to jet out the ink, and the cleaning is stopped. The user confirms the restoration of the clogging by seeing the result of this test printing.

(S17) If the clogging is not yet restored, the cleaning is conducted once again. In this example, the user depresses a re-cleaning switch. With this operation, the number-of-times parameter n is updated to n+1, and the processing returns to step S12. Whereas if the clogging is removed, the cleansing is stopped.

In accordance with this embodiment, in the case of comparatively heavily-clogged states of the nozzles, it may happen that all the nozzles are not restored by one ink sucking/discharging operation. Then, a predetermined number-of-times N is set, and, within a range of this number-of-times N, the ink sucking/discharging operation is repeated.

Note that the clogging is determined by the user as exemplified above, but, in addition to this, there may be adopted a method of confirming the clogging by providing an optical sensor for automatically scanning a state of the test printing. Similarly, the inks from the nozzles are jetted against an electrode plate, and a quantity of electric charges of the inks is measured, whereby the restoration of all the nozzles may be detected.

Figure 15:
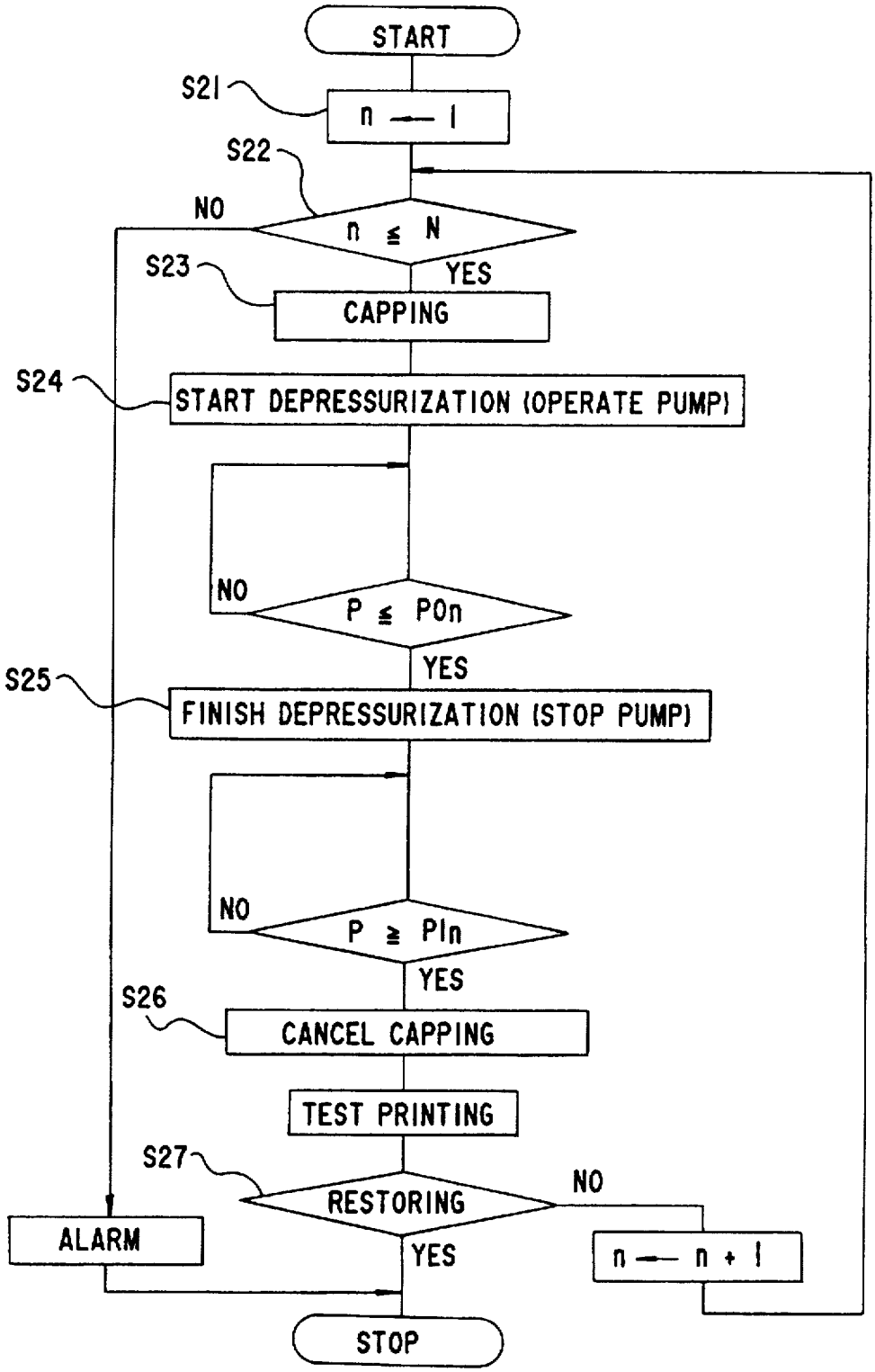
FIG. 15 is an operation flowchart in a third modified example of the present invention.

FIG. 15 is an operation flowchart in a third modified example of the present invention. In this modified example also, there is used the cap 4 shown in FIGS. 12A and 12B.

Steps S21–S27 in this modified example are almost the same as steps S11–S17 in the modified example of FIG. 14. In steps S24 and S25, however, the predetermined pressures P0, P1 compared with the intracap pressure P are changed in accordance with the number-of-times n.

More specifically, in step S24, the predetermined depressurization stopping pressure P0 of each time is set to P0(n). However, P0(n) is set smaller (larger in the negative direction) than P0(n-1). With this setting, the sucking force is increased by gradually decreasing the reduced pressure.

Similarly, in step S25, the predetermined end pressure P1 of each time is set to P1(n). P1(n) is, however, set smaller than P1(n-1). With this setting, the end pressure is gradually reduced.

In accordance with this embodiment, in the case of the comparatively heavily-clogged states of the nozzles, it may happen that all the nozzles are not restored by one ink sucking/discharging operation. Then, the predetermined number-of-times N is set, and, within the range of this number-of-times N, the ink sucking/discharging operation is repeated. Further, the second and subsequent operations are to be carried by a larger sucking force.

Figure 16:
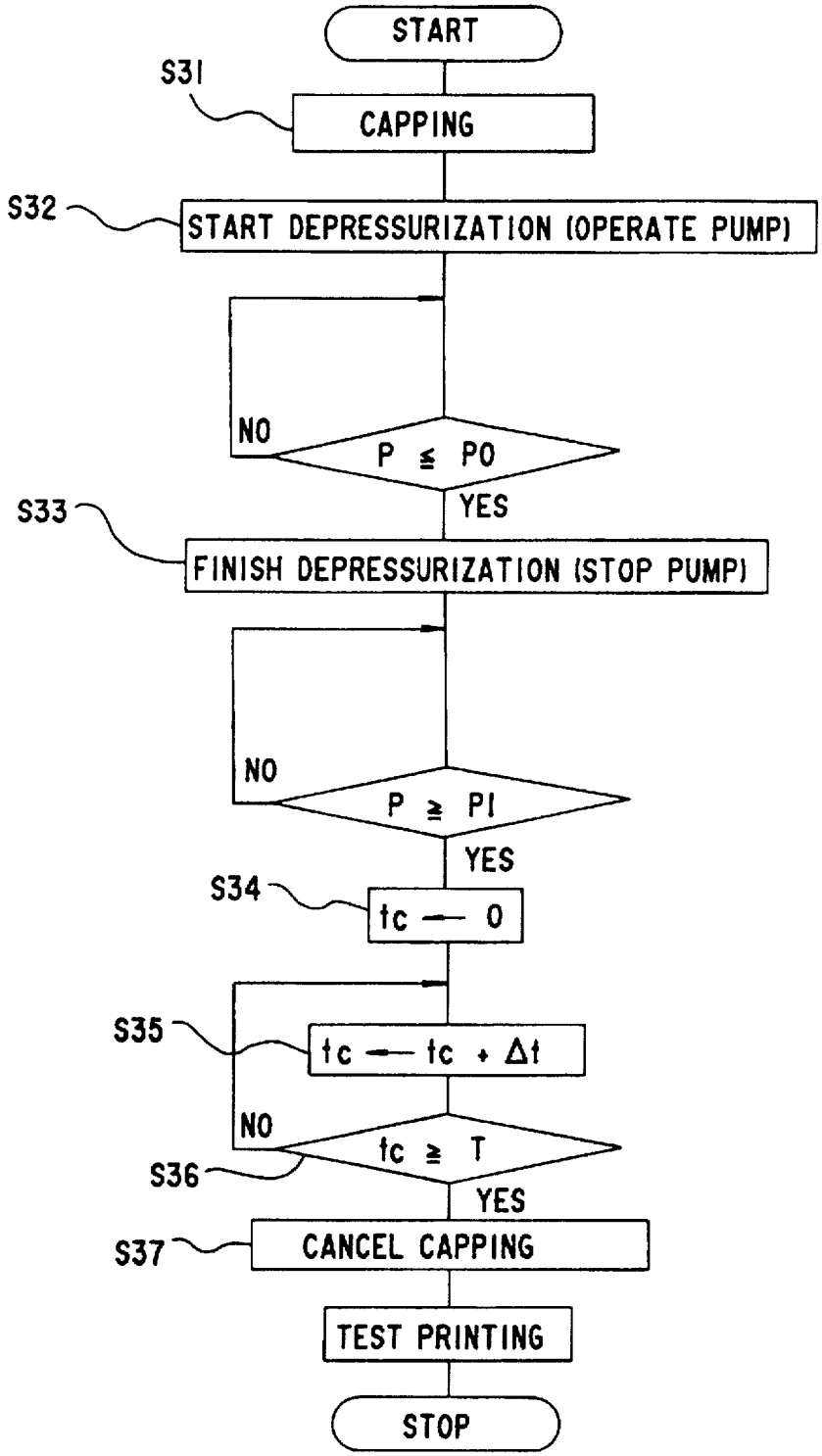
FIG. 16 is an operation flowchart in a fourth modified example of the present invention.

FIG. 16 is an operation flowchart in a fourth modified example of the present invention. In this modified example, there is used the cap 4 shown in FIGS. 12A and 12B.

(S31) If the user recognizes the nozzle clogging from the printing state and so forth, there is turned ON the switch for starting the ink cleaning operation on the operation panel. The operation is thereby started. At the first onset, there is conducted the capping operation to cover the nozzle surface 21 of the head 20 with the cap 4.

(S32) Next, the control circuit 38 operates the depressurizing pump 36 to reduce the intra-cap pressure. The control circuit 38 reads the output of the pressure sensor 45 at the interval of the predetermined time and thus detects the intra-cap pressure. The control circuit 38 determines whether or not the intra-cap pressure P is equal to or smaller than the predetermined depressurization stopping pressure $P0=1-S\cdot L/V$ (where S is the area of the whole nozzle region, L is the average spacing between the whole nozzle region and the cap internal surface bearing the face-to-face relationship therewith, and V is the intra-cap capacity).

(S33) The control circuit 38, when determining that the intra-cap pressure P is P0 or under ( the n P=Pa), stops the operation of the depressurization pump 36. Because of the one-way valve 35 provided on the route of the depressurization pump 36, there is produced no rise in terms of the pressure from this route. However, the inks are discharged from the nozzles, and, therefore, the intra-cap pressure P increases. The control circuit 38 reads the output of the pressure sensor 45 at the interval of the predetermined time and thus detects the intracap pressure. Then, the control circuit 38 determines whether or not the intra-cap pressure P is equal to or larger than the predetermined end pressure $P1=Pa+S\cdot L/V$.

(S34) The control circuit 38, when determining that the intra-cap pressure P is equal to or larger than P1, initializes a holding time tc to [0].

(S35) The control circuit 38 updates the holding time tc to tc+Δt.

(S36) The control circuit 38 determines whether or not the holding time tc is equal to or larger than a limit time T. If the holding time tc is not equal to or larger than the limit time T, the processing goes back to step S35.

(S37) The control circuit 38, when the holding time tc is equal to or larger than the limit time T, retracts the cap 4 from the nozzle surface, thus canceling the capping operation. At this point of time, the inks discharged into the cap have the quantity greater than needed for wetting the whole nozzle region. Effected subsequently is test printing to jet out the ink, and the cleaning is stopped. The user confirms the restoration of the clogging by seeing the result of this test printing.

In this modified example, it takes much time until the deposited/solidified matters causing the clogging in the nozzles are dissolved by the inks. In the case of the light clogging caused by an increase in viscosity, a partial deposition and solidification to such a degree that a thin film is formed, although depending on the deposited/solidified states, the deposited/solidified matters are dissolved with an instant wet of ink. On the other hand, if the solidification goes on up to the interior of the nozzle, the wetted state is required to be held for several minutes. Then, the ink discharging operation is started to depressurize the interior of the cap. Subsequently, from a point of time when the inks suck-discharged into the cap comes to have a quantity necessary for wetting the whole nozzle region, the wetted state is kept for a fixed time, and the clogging is thereby removed more surely than before.

(S41) If the user recognizes the nozzle clogging from the printing state and so forth, there is turned ON the switch for starting the ink cleaning operation on the operation panel. The operation is thereby started. The number-of-times parameter n is initialized to [1].

(S42) The control circuit 38 determines whether or not the number-of-times parameter n is equal to or smaller than the limit number-of-times N. If the number-of-times parameter n is not equal to or smaller than the limit number-of-times N, this implies the excess in terms of the number of times, and therefore the operation is stopped by giving the alarm.

(S43) If the number-of-times parameter n is equal to or smaller than the limit number-of-times N, there is performed at first the capping operation to cover the nozzle surface 21 of the head 20 with the cap 4.

(S44) Next, the control circuit 38 operates the depressurizing pump 36 to reduce the intra-cap pressure. The control circuit 38 reads the output of the pressure sensor 45 at the interval of the predetermined time and thus detects the intra-cap pressure. The control circuit 38 determines whether or not the intra-cap pressure P is equal to or smaller than the predetermined depressurization stopping pressure P0=1=S·L/V (where S is the area of the whole nozzle region, L is the average spacing between the whole nozzle region and the cap internal surface bearing the face-to-face relationship therewith, and V is the intra-cap capacity).

(S45) The control circuit 38, when determining that the intra-cap pressure P is P0 or under (then P=Pa), stops the operation of the depressurization pump 36. Because of the one-way valve 35 provided on the route of the depressurization pump 36, there is produced no rise in terms of the pressure from this route. However, the inks are discharged from the nozzles, and, therefore, the intra-cap pressure P increases. The control circuit 38 reads the output of the pressure sensor 45 at the interval of the predetermined time and thus detects the intracap pressure. Then, the control circuit 38 determines whether or not the intra-cap pressure P is equal to or larger than the predetermined end pressure P1=Pa+S·L/V.

(S46) The control circuit 38, when determining that the intra-cap pressure P is equal to or larger than P1, initializes the holding time tc to [0].

(S47) The control circuit 38 updates the holding time tc to tc+Δt.

(S48) The control circuit 38 determines whether or not the holding time tc is equal to or larger than the limit time T. If the holding time tc is not equal to or larger than the limit time T, the processing returns to step S47.

(S49) The control circuit 38, when the holding time tc is equal to or larger than the limit time T, retreats the cap 4 from the nozzle surface, thus canceling the capping operation. At this point of time, the inks discharged into the cap have the quantity greater than needed for wetting the whole nozzle region. Effected subsequently is test printing to jet out the ink, and the cleaning is stopped. The user confirms the restoration of the clogging by seeing the result of this test printing.

(S50) If the clogging is not yet restored, the cleaning is conducted once again. In this example, the user depresses the re-cleaning switch. With this operation, the number-of-times parameter n is updated to n+1, and the processing returns to step S42. Whereas if the clogging is removed, the cleansing is stopped.

In accordance with this embodiment, the holding time of FIG. 16 is added to the modified example of FIG. 14. Accordingly, this embodiment exhibits effects of a combination of the two.

Figure 19:
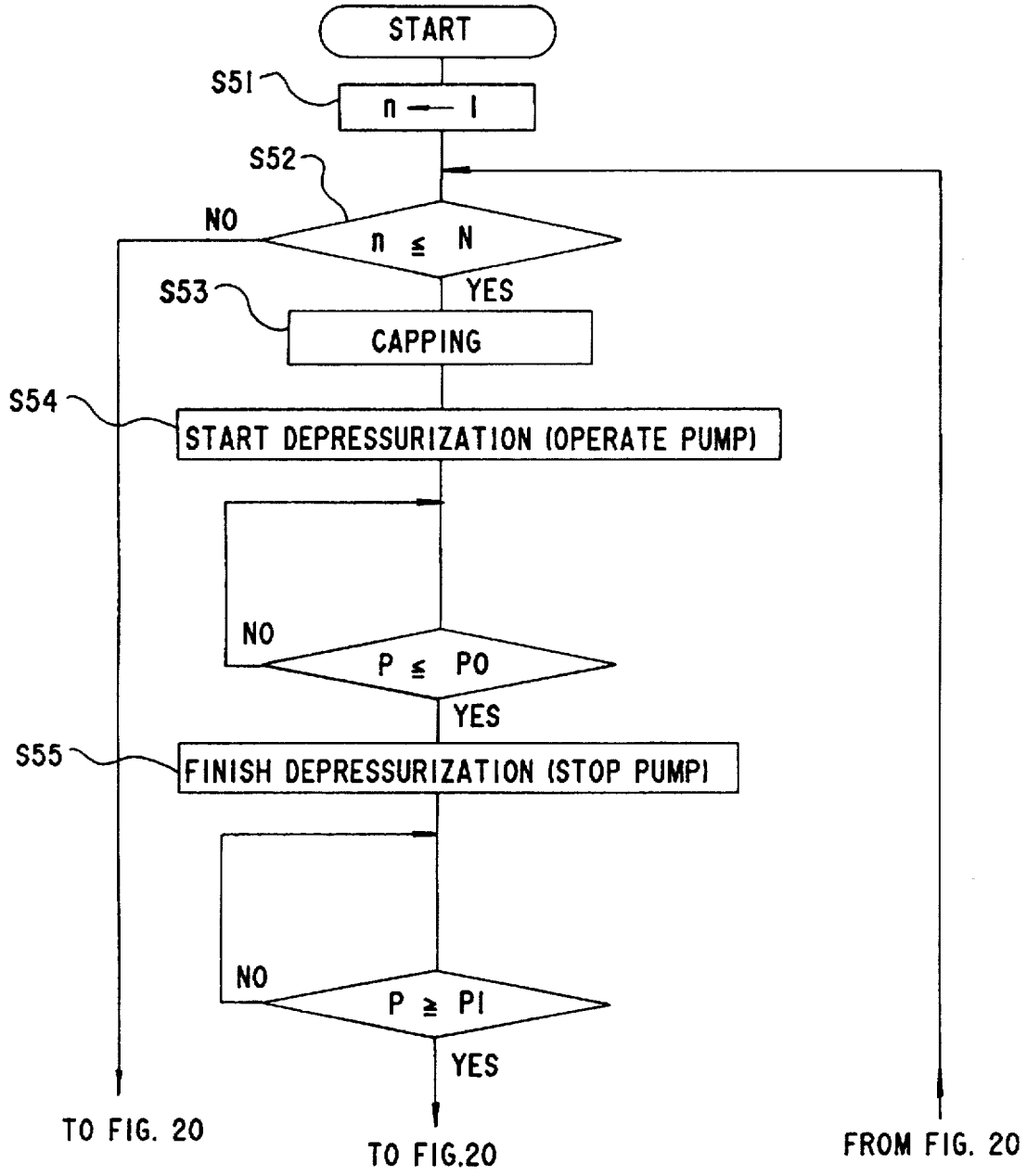
FIGS. 19 and 20 are operation flowcharts in a sixth modified example of the present invention.
Figure 20:
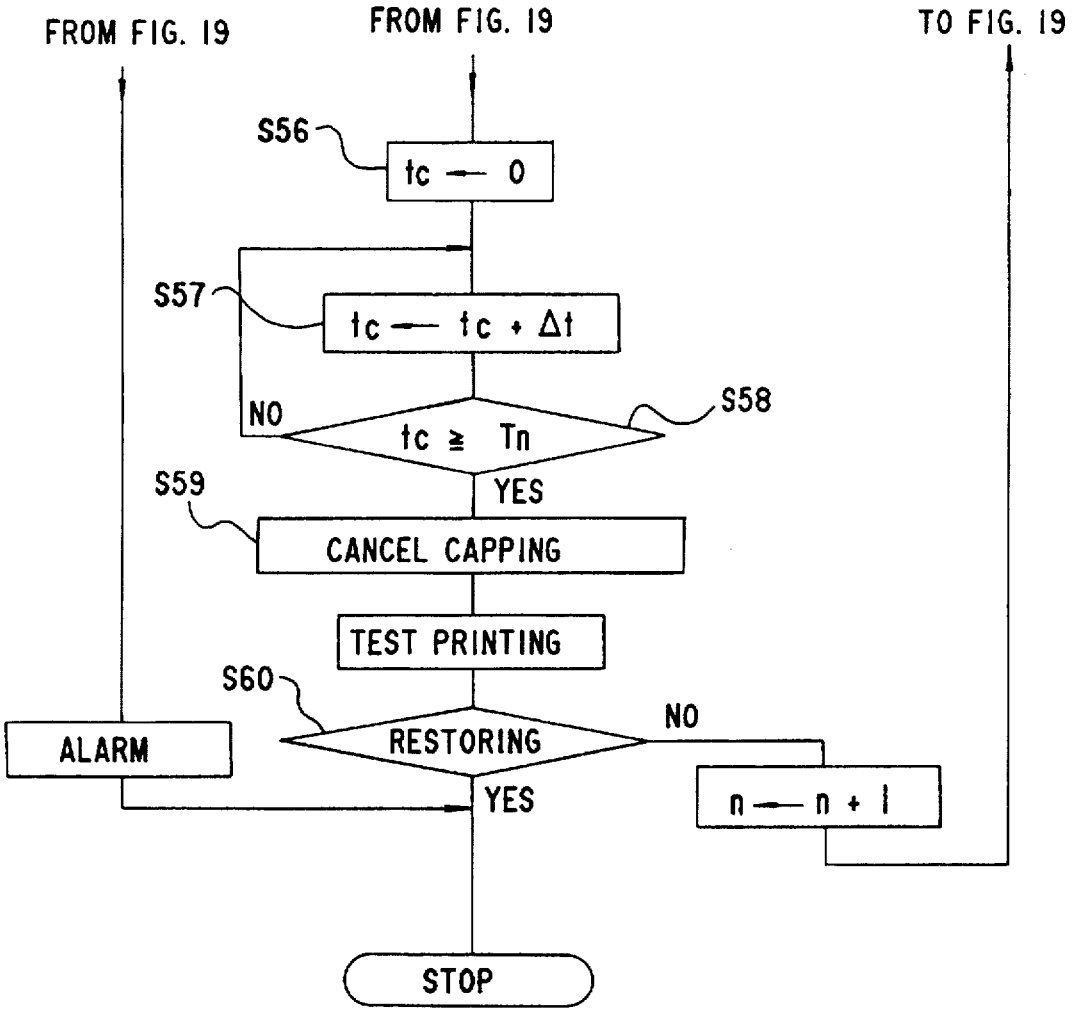

FIGS. 19 and 20 are operation flowcharts in a sixth modified example of the present invention. In this modified example also, there is used the cap 4 shown in FIGS. 12A and 12B.

(S51) If the user recognizes the nozzle clogging from the printing state and so forth, there is turned ON the switch for starting the ink cleaning operation on the operation panel. The operation is thereby started. The number-of-times parameter n is initialized to [1].

(S52) The control circuit 38 determines whether or not the number-of-times parameter n is equal to or smaller than a limit number-of-times N. If the number-of-times parameter n is not equal to or smaller than the limit number-of-times N, this implies the excess in terms of the number of times, and therefore the operation is stopped by giving the alarm.

(S53) If the number-of-times parameter n is equal to or smaller than the limit number-of-times N, there is performed at first the capping operation to cover the nozzle surface 21 of the head 20 with the cap 4.

(S54) Next, the control circuit 38 operates the depressurizing pump 36 to reduce the intra-cap pressure. The control circuit 38 reads the output of the pressure sensor 45 at the interval of the predetermined time and thus detects the intra-cap pressure. The control circuit 38 determines whether or not the intra-cap pressure P is equal to or smaller than the predetermined depressurization stopping pressure P0=1−S·L/V (where S is the area of the whole nozzle region, L is the average spacing between the whole nozzle region and the cap internal surface bearing the face-to-face relationship therewith, and V is the intra-cap capacity).

(S55) The control circuit 38, when determining that the intra-cap pressure P is P0 or under (then P=Pa), stops the operation of the depressurization pump 36. Because of the one-way valve 35 provided on the route of the depressurization pump 36, there is produced no rise in terms of the pressure from this route. However, the inks are discharged from the nozzles, and, therefore, the intra-cap pressure P increases. The control circuit 38 reads the output of the pressure sensor 45 at the interval of the predetermined time and thus detects the intracap pressure. Then, the control circuit 38 determines whether or not the intra-cap pressure P is equal to or larger than the predetermined end pressure P1=Pa+S·L/V.

(S56) The control circuit 38, when determining that the intra-cap pressure P is equal to or larger than P1, initializes the holding time tc to [0].

(S57) The control circuit 38 updates the holding time tc to tc+Δt.

(S58) The control circuit 38 determines whether or not the holding time tc is equal to or larger than a limit time Tn. The limit time Tn changes with the number-of-times n serving as a parameter. That is, the holding time Tn increases with a rise in the number-of-times n. The holding time tc increases with a rise in the number-of-times n. If the holding time tc is not equal to or larger than the limit time Tn, the processing returns to step S57.

(S59) The control circuit 38, when the holding time tc is equal to or larger than the limit time Tn, retracts the cap 4 from the nozzle surface, thus canceling the capping operation. At this point of time, the inks discharged into the cap have the quantity greater than needed for wetting the whole nozzle region. Effected subsequently is test printing to jet out the ink, and the cleaning is stopped. The user confirms the removal of the clogging by seeing the result of this test printing.

(S60) If the clogging is not yet removed, the cleaning is conducted once again. In this example, the user depresses the re-cleaning switch. With this operation, the number-of-times parameter n is updated to n+1, and the processing goes back to step S52. Whereas if the clogging is removed, the cleansing is stopped.

Figure 17:
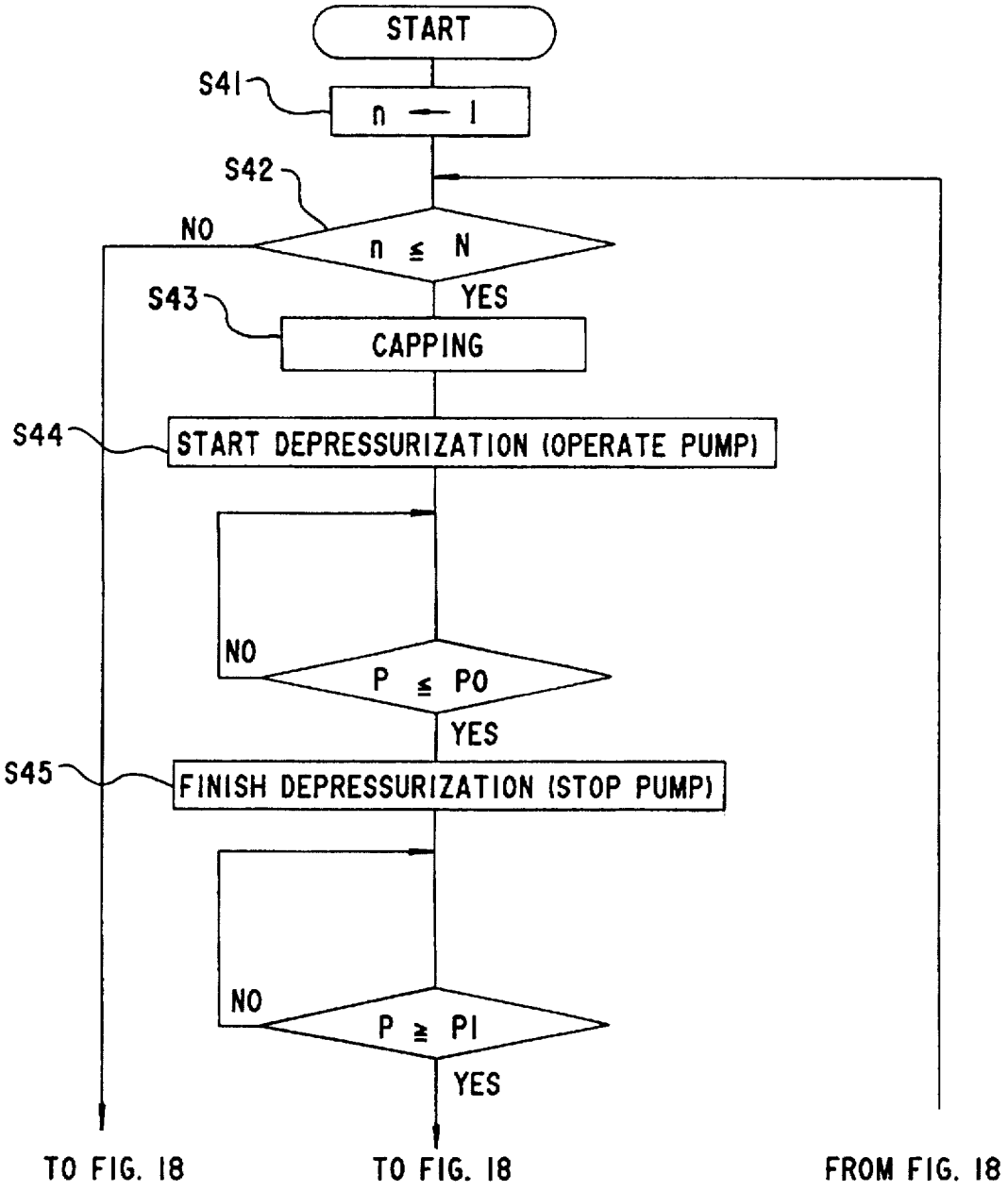
FIGS. 17 and 18 are operation flowcharts in a fifth modified example of the present invention.
Figure 18:
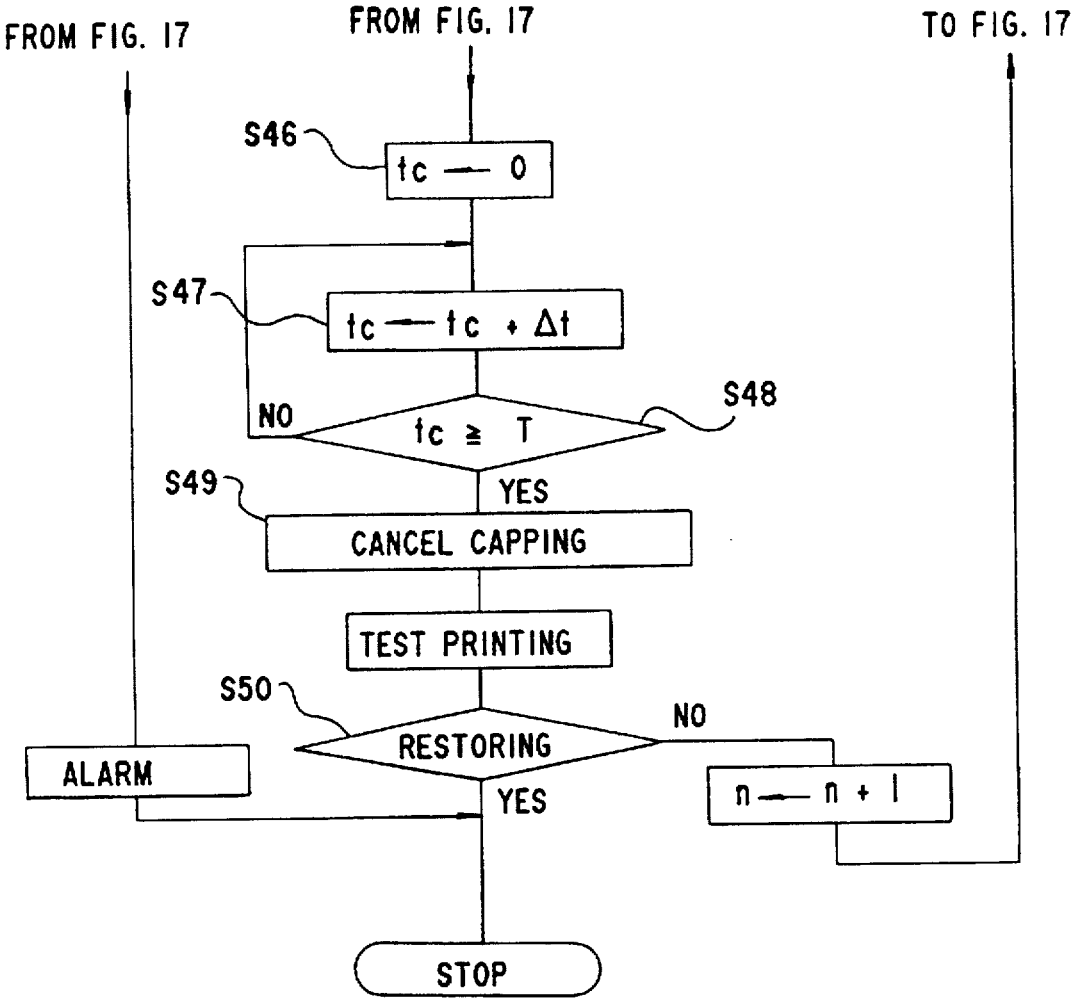

In accordance with this embodiment, the holding time tc increases corresponding to the number of repetitions of cleaning in the example of FIGS. 17 and 18. Hence, the heavier clogging can be removed.

In addition to the embodiments discussed above, the following modifications can be carried out.

First, a variety of modified examples have been described, but the present invention is applicable with a combination of these two or more modified examples. Second, the head has been explained as a serial type of head. The present invention is, however, applicable to a line type of head and a color type of head. Third, the ink jet head has been explained as a piezoelectric element drive type of head. The present invention is, however, applicable to a bubble drive type, a thermal drive type and an electrostatic drive type. Fourth, the applicable inks may include an aqueous ink, a non-aqueous/non-oil ink and an oil ink The present invention has been discussed so far by way of the embodiments. However, a variety of modifications can be carried out within the range of the gist of the present invention but are not excluded from the scope of the present invention.

As discussed above, according to the present invention, the inks suck-discharged from the comparatively lightly-clogged nozzles wet the plurality of nozzles as a whole. Besides, the deposited/solidified matters in the clogged nozzles are dissolved by the inks, and, hence, the quantity of dissipation of the inks needed for restoring the clogging can be minimized. Further, the sucking force may be small enough to reduce the size of the depressurizing pump. Moreover, the operating time can be also decreased.

What is claimed is:

1. A method of cleaning an ink jet head having a plurality of nozzles for effecting a record by jetting ink from openings in the ends of said nozzles onto a recording medium, said method comprising the steps of:

covering a nozzle surface containing the ends of said plurality of nozzles of said ink jet head with a cap to form an air space between said nozzle surface and said cap and closed to the exterior thereof;

depressurizing said air space by use of depressurizing means to suck ink from said nozzles into said air space;

stopping the depressurization by said depressurizing means upon achieving a predetermined negative pressure condition in said air space;

keeping the nozzle surface covered by said cap closed to the exterior thereof while maintaining a depressurized state in said air space for a period of time so that the ink extracted from said nozzles due to the depressurization wet-spreads over the entire nozzle surface by a capillary force to immerse said openings of said nozzles and dissolve deposited or solidified solutes therein; and thereafter, retracting said cap from the nozzle surface.

2. A method of cleaning an ink jet head according to claim 1, wherein said depressurizing step is a step of producing a reduced pressure equal to or smaller than 1−(S·L/V) where S is the area of the nozzle surface including all said plurality of nozzles, L is the average spacing between the region of the nozzle surface and the cap internal surface bearing a face-to-face relationship with said region, and V is the intra-cap capacity when said plurality of nozzles are covered with said cap.

3. A method of cleaning an ink jet head according to claim 1, wherein said nozzle surface is kept covered by said cap and closed to the exterior thereof until a pressure within the air space reaches atmospheric pressure.

4. A method of cleaning an ink jet head according to claim 2, wherein said nozzle surface is kept covered by said cap and closed to the exterior thereof until a pressure within the air space reaches atmospheric pressure.

5. A method of cleaning an ink jet head according to claim 1, wherein said nozzle surface is kept covered by said cap and closed to the exterior thereof until a predetermined holding time elapses after pressure within the air space has reached atmospheric pressure.

6. A method of cleaning an ink jet head according to claim 2, wherein said nozzle surface is kept covered by said cap and closed to the exterior thereof until a predetermined holding time elapses after a pressure within the air space has reached atmospheric pressure.

7. A method of cleaning an ink jet head according to claim 1, further comprising a step of repeating said steps starting with said step of covering the nozzle surface with said cap when clogging in said nozzles on the nozzle surface is not removed.

8. A method of cleaning an ink jet head according to claim 7, wherein said repeating step includes a step of gradually enhancing the reduced pressure by said depressurizing means in said depressurizing step.

9. A method of cleaning an ink jet head according to claim 6, further comprising a step of repeating said steps starting with said step of covering the nozzle surface with said cap when clogging in said nozzles on the nozzle surface is not removed, said repeating step including a step of gradually increasing die holding time in said keeping step.

10. An apparatus for cleaning an ink jet head having a plurality of nozzles defining a nozzle surface containing nozzles having openings for effecting a record by jetting out ink on a recording medium, said apparatus comprising:

a cap for covering said nozzle surface to form an air space between said nozzle surface and said cap and closed to the exterior thereof;

depressurizing means communicating with said air space for depressurizing said air space to suck ink from said nozzle openings; and means for maintaining a depressurized state in said air space following termination of operation of the depressurizing means and while said air space is closed to the exterior thereof at least until said air space contains ink sufficient to cover the openings of said plurality of nozzles for a period of time sufficient to dissolve deposited or solidified solutes therein, wherein a contact angle θ1 between the ink and the cap internal surface and a contact angle θ2 between the ink and the nozzle surface are set to 90° or smaller and also set as θ2 is not greater than θ1.

11. An apparatus for cleaning an ink jet head according to claim 10, wherein the nozzle surface and an internal surface of the cap are formed so that the contact angel θ1 and the contact angle θ2 are set to 90° or smaller and also set such that θ2 is not greater than θ1.

12. An apparatus for cleaning an ink jet head according to claim 10, wherein the ink has a composition producing a contact angle θ1 and a contact angle θ2 set to 90° or smaller and also set such that θ2 is not greater than θ1.

13. An apparatus for cleaning an ink jet head according to claim 10, wherein said cap is provided in a face-to-face-position with the nozzle surface with respect to the cap internal surface and further includes a member for narrowing a spacing between the cap internal surface and the nozzle surface.

14. An apparatus for cleaning an ink jet head according to claim 10, wherein said cap has a closed surface bearing a face-to-face relationship with the nozzle surface.

15. An apparatus for cleaning an ink jet head according to claim 10, wherein said ink jet head includes a surface peripheral to the nozzle surface that produces a contact angle different from that produced on the nozzle surface on which said plurality of nozzles are arranged.

16. An apparatus for cleaning an ink jet head according to claim 10, further comprising:

pressure detecting means for detecting a pressure in said air space within said cap; and a control circuit for controlling said depressurizing means in accordance with a detected output of said pressure detecting means.

17. An apparatus for cleaning an ink jet head having a plurality of nozzles for effecting a record by jetting ink from openings in the ends of said nozzles onto a recording medium, said apparatus comprising:

a cap for covering a nozzle surface containing said nozzle openings to form an air space between said nozzle surface and said cap and closed to the exterior thereof;

depressurizing means communicating with said air space for depressurizing said air space to suck ink from said nozzles;

a cap operating mechanism for closely fitting said cap to the nozzle surface and retracting said cap therefrom;

means for maintaining said air space closed and depressurized following termination of operation of the depressurizing means; and a control circuit operative to control said cap operating mechanism and said depressurizing means, said control circuit including means for closely fitting said cap to the nozzle surface to form said air space, means for operating said depressurizing means after said cap is fitted to said nozzle surface for a limited period of time sufficient to provide a predetermined negative pressure within said air space and then to stop operation of said depressurizing means, means operative to maintain said cap fitted to the nozzle surface and closed to the exterior of said cap to enable the negative pressure in the air space to extract ink from said nozzles and to wet-spread over the nozzle surface to immerse the nozzle openings by dint of capillary force whereby solutes deposited or solidified in said nozzles are dissolved, and means for retracting said cap from the nozzle surface.

18. An apparatus for cleaning an ink jet head according to claim 17, wherein said control circuit controls said depressurizing means to give a reduced pressure equal to or smaller than $1-(S \cdot L/V)$ where S is the area of the nozzle surface including all said plurality of nozzles, L is the average spacing between this region and the cap internal surface bearing a face-to-face relationship with this region, and V is the intra-cap capacity when said plurality of nozzles are covered with said cap.

19. An apparatus for cleaning an ink jet head according to claim 17, wherein said control circuit controls said cap operating mechanism to cover the nozzle surface with said cap and to maintain it closed to the exterior thereof until the pressure within the air space reaches atmospheric pressure.

20. An apparatus for cleaning an ink jet head according to claim 17, wherein said control circuit controls said cap operating mechanism to cover the nozzle surface with said cap and to maintain it closed to the exterior thereof until a predetermined holding time elapses after a pressure within the air space has reached atmospheric pressure.

21. An apparatus for cleaning an ink jet head according to claim 17, further comprising pressure detecting means for detecting a pressure in the air space within said cap, said control circuit controlling said depressurizing means in accordance with a detected output of said pressure detecting means.

22. An apparatus for cleaning an ink jet head according to claim 17, further comprising pressure detecting means for detecting a pressure in the air space within said cap, said control circuit controlling said depressurizing means and said cap operating mechanism in accordance with a detected output of said pressure detecting means.

23. An apparatus for cleaning an ink jet head according to claim 17, wherein a contact angle θ1 between the ink and the cap internal surface and a contact angle θ2 between the ink and the nozzle surface are set to 90° or smaller and also set such as θ2 is not greater than θ1.

* * * * *